US011859832B2

(12) United States Patent
Ribeiro et al.

(10) Patent No.: US 11,859,832 B2
(45) Date of Patent: Jan. 2, 2024

(54) GRAY WATER HEAT RECOVERY APPARATUS AND METHOD

(71) Applicant: 2078095 Ontario Limited, Toronto (CA)

(72) Inventors: Adelino Ribeiro, Richmond Hill (CA); Vicente Gil, Toronto (CA); John Gil, Toronto (CA); Camilo Gil, Toronto (CA); David Ribeiro, Richmond Hill (CA)

(73) Assignee: 2078095 Ontario Limited

( * ) Notice: Subject to any disclaimer, the term of this patent is extended or adjusted under 35 U.S.C. 154(b) by 155 days.

(21) Appl. No.: 17/354,981

(22) Filed: Jun. 22, 2021

(65) Prior Publication Data

US 2022/0404036 A1 Dec. 22, 2022

(51) Int. Cl.
*F24D 17/00* (2022.01)
*F24D 11/00* (2022.01)

(52) U.S. Cl.
CPC ..... *F24D 17/0005* (2013.01); *F24D 11/005* (2013.01); *F24D 2200/20* (2013.01)

(58) Field of Classification Search
CPC ..... F24D 17/0005; F24D 11/005; F24D 2200/20; F28D 21/0012; Y02B 30/56; E03C 2001/005; F28F 1/022
See application file for complete search history.

(56) References Cited

U.S. PATENT DOCUMENTS

| | | | |
|---|---|---|---|
| 1,955,477 | A | 4/1934 | Turner |
| 1,987,051 | A | 1/1935 | Cattanach |
| 1,987,891 | A | 1/1935 | Cattanach |
| 1,989,340 | A | 1/1935 | Shepherd |

(Continued)

FOREIGN PATENT DOCUMENTS

| | | | |
|---|---|---|---|
| AU | 762513 | * | 6/2000 |
| AU | 199964518 B2 | | 6/2003 |

(Continued)

OTHER PUBLICATIONS

Frionic Forstner waste heat recovery from refrigeration plants: Waste Heat Recovery from Refrigeration.

(Continued)

*Primary Examiner* — Frantz F Jules
*Assistant Examiner* — Martha Tadesse
(74) *Attorney, Agent, or Firm* — Smart & Biggar LP

(57) ABSTRACT

A gray water heat recovery apparatus has first and second passes in counter-flow orientation. The hot side is gray water. The cold side is fresh water. It extracts heat from the gray water. The fresh water is carried in tubing bundles in series immersed in gray water sumps in a unitary cylindrical plastic, mild steel, stainless steel or copper pipe section that defines multiple flow passages. Both ends of the fresh water bundle assembly extend from the same upper end pipe closure, without a pressurized line wall penetration in the walls of the pipe. There is a non-electrically conductive barrier between the fresh water and gray water flow paths. The apparatus has a leak detection circuit and co-operable bypass valves. The lower manifold has gray water passages between the centering ears. The entire assembly is enclosed in a unitary external housing with axially accessible connection fittings.

20 Claims, 17 Drawing Sheets

(56) References Cited

U.S. PATENT DOCUMENTS

Figure 1:
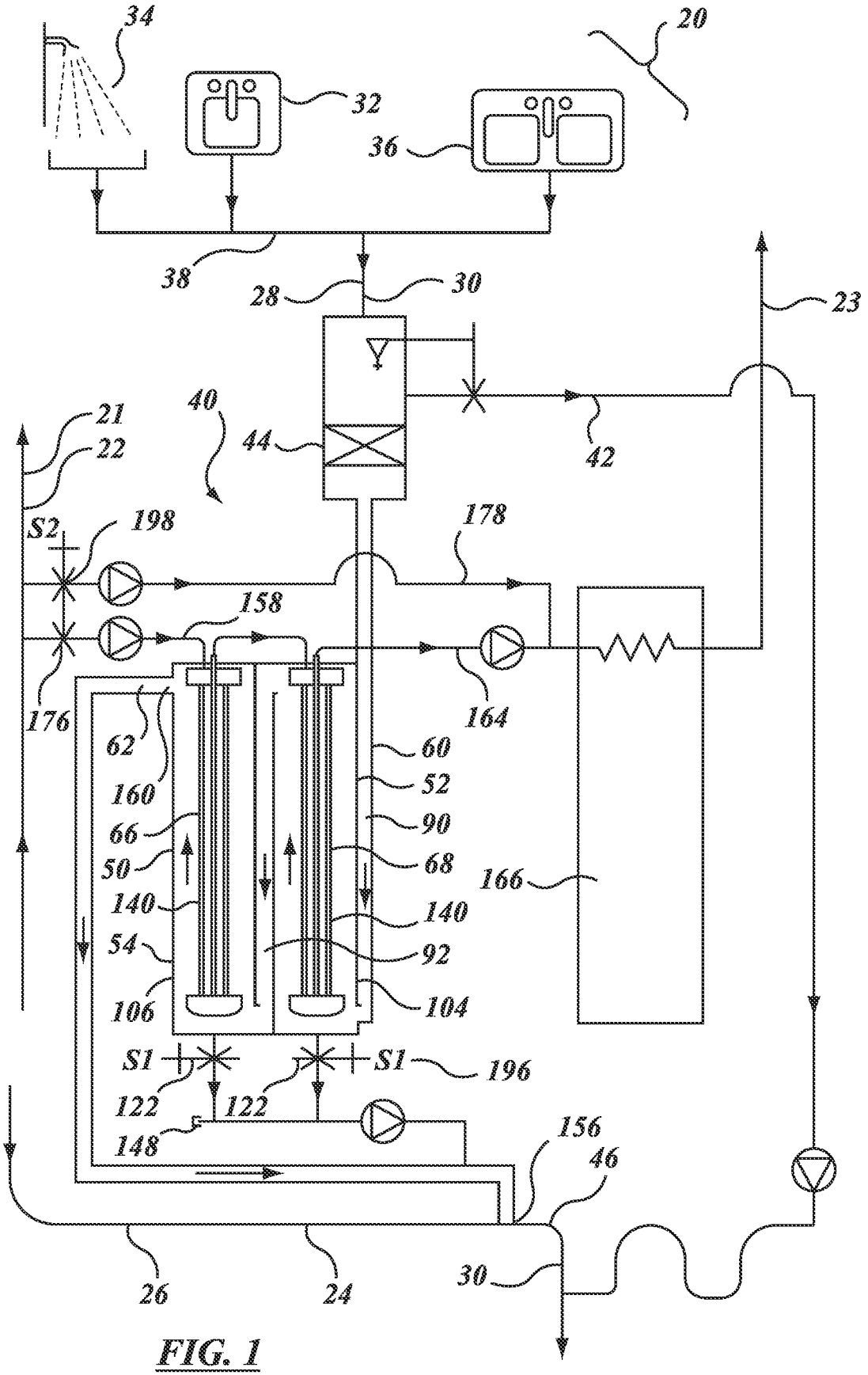

| | | | | |
|---|---|---|---|---|
| 2,482,335 | A | 9/1949 | Fleitz | |
| 3,656,543 | A | 4/1972 | Wolowodiuk | |
| 3,760,870 | A | 9/1973 | Guetlhuber | |
| 4,138,856 | A | 2/1979 | Orlowsi | |
| 4,138,969 | A * | 2/1979 | Thompson | F28F 11/00 122/421 |
| 4,202,406 | A | 5/1980 | Avery | |
| 4,256,176 | A | 3/1981 | Cohen | |
| 4,454,911 | A | 6/1984 | Arbabian | |
| 4,531,572 | A | 7/1985 | Molitor | |
| 4,602,682 | A | 7/1986 | Yamamoto | |
| 5,148,858 | A | 9/1992 | Ovretveit | |
| 5,191,785 | A | 3/1993 | Kidd | |
| 5,301,745 | A | 4/1994 | Seib et al. | |
| 5,334,973 | A | 8/1994 | Furr | |
| 5,740,857 | A | 4/1998 | Thompson | |
| 6,062,068 | A | 5/2000 | Bowling | |
| 6,662,632 | B1 | 12/2003 | Parker | |
| 7,561,057 | B2 | 7/2009 | Kates | |
| 2007/0051166 | A1 | 3/2007 | Baker | |
| 2010/0200203 | A1 | 8/2010 | Postma | |
| 2011/0024080 | A1 | 2/2011 | Bose et al. | |
| 2011/0107512 | A1 | 5/2011 | Gilbert | |
| 2011/0203786 | A1 | 8/2011 | Darnell et al. | |
| 2011/0226341 | A1 | 9/2011 | Platteel et al. | |
| 2012/0255706 | A1 | 10/2012 | Tadayon et al. | |
| 2012/0318483 | A1 | 12/2012 | Cosby | |
| 2013/0228309 | A1 | 9/2013 | Wood et al. | |
| 2013/0306289 | A1 * | 11/2013 | McKelvie | F28F 1/00 165/181 |
| 2016/0370120 | A1 * | 12/2016 | Ramamoorthy | B23P 15/26 |
| 2018/0187980 | A1 * | 7/2018 | Gil | F28D 7/024 |

FOREIGN PATENT DOCUMENTS

| | | | |
|---|---|---|---|
| DE | 102008017380 | A1 | 3/2009 |
| EP | 2693146 | A1 | 2/2014 |
| GB | 2247072 | A | 2/1992 |
| WO | 2011158032 | A2 | 12/2011 |
| WO | 2014029992 | A1 | 2/2014 |

OTHER PUBLICATIONS

Intewa: Create portable water easily and economically with new water system technology that also combines heat recovery; dated May 1, 2014.

CANMET Energy Technology Centre: Design and Analysis of a Residential Greywater Heat Recovery System; dated Feb. 12, 2003.

TotalPatent: machine English translation of the abstract, as retrieved in connection to German patent publication DE102008017380.

* cited by examiner

GRAY WATER HEAT RECOVERY APPARATUS AND METHOD

FIELD OF INVENTION

This description relates to the field of apparatus for heat recovery from gray water, particularly as in residential installations.

BACKGROUND OF THE INVENTION

It is known to recover heat from gray water that would otherwise be subject to disposal. Examples of such systems are shown in WIPO publication WO 2014/029992 of Murray, et al., and US Publication 2011/0 107 512 of Gilbert, and also in U.S. Pat. No. 10,203,166 of Gil and U.S. Pat. No. 10,775,112 of Gil. The detailed descriptions and illustrative drawing figures of the two Gil patents are intended to be incorporated herein in their entirety.

SUMMARY OF INVENTION

The following summary precedes the more detailed discussion to follow. The summary is not intended to, and does not, limit or define the claims.

In an aspect of the invention there is a gray water heat recovery apparatus in which heat is transferred between a gray water stream and a fresh water stream. It has a heat exchanger that has at least a first pass and a second pass formed within a unitary cylindrical housing in which both said first pass and said second pass are formed. The first pass and second pass are mounted in series. The heat exchanger has a gravity-fed gray water flow path, the gray water flow path including a first portion in the first pass, and a second portion in the second pass. The gray water flow path has a source inlet, and a drain outlet. The gray water flow path has an intermediate portion lower than the drain outlet. The heat exchanger has a pressure-fed fresh water flow path. The fresh water flow path is segregated from the gray water flow path. The fresh water flow path has a counter-flow orientation relative to the gray water flow path. The fresh water flow path of the heat exchanger is at least predominantly immersed in the gray water flow path. The fresh water flow path has a fresh water source and a fresh water outlet, both the fresh water source and the fresh water outlet is positioned at respective heights higher than the drain outlet of the gray water flow path.

In a feature of that aspect, the first shell has a resting sump fluid level, and the first portion of the fresh water flow path has an entrance to and an exit from the first shell, both of the entrance and the exit are at least as high as the resting sump fluid level. In another feature, the first shell has at least one plug fitting. In another feature, at least one of the inlet and outlet ports has an upwardly tilted spout and the resting water level of the sump is closer to the top of the sump than a distance that is one half of the diameter of the outlet fitting.

In another aspect of the invention, there is a gray water heat recovery apparatus having a one-piece cylindrical gray water shell. The shell has first and second gray water passes having respective top and bottom ends. The first and second gray water passes are in fluid connection in series and combine to define a gravity driven gray water discharge path. First and second tube bundles are removably installed in the second and first gray water passes by axial insertion at the top end of the cylindrical shell. The first and second tube bundles are pressurized fresh water tube bundles. Each tube bundle has an inlet manifold, a return manifold, an array of heat exchanger tubes extending between and in communication with the inlet manifold and the return manifold, and a return. The first and second tube bundles, when installed, are connected in series and in counterflow to the first and second gray water passes of the shell. The top end of the shell has at least a first divider between the first gray water pass and the second gray water pass. The shell has an upstanding peripheral wall. The upstanding peripheral wall has first and second gray water port fittings mounted therein, one of the fittings being a gray water inlet in fluid communication to feed the first and second gray water passes in series, and the other of the fittings being a gray water outlet at which grew water exits from the shell after having passed through the first and second gray water passes in series. The housing assembly includes a top end cover that closes the top end of the first and second passes. The top end cover, when installed, captures the first and second gray water port fittings in the upstanding peripheral wall of the gray water shell.

In a feature of that aspect, the passes in the shell are connected to cause gray water to rise in both the first and second gray water passes when the apparatus is in operation. In another feature, the tube bundles each have an array of a plurality of heat exchange pipes in which to carry fresh water from an inlet manifold to a return manifold, and a return to pipe connected to carry fresh water from the return manifold to the top end of the shell. The first and second tube bundles are connected to cause fresh water to descend in the respective arrays of heat exchange pipes during operation of the gray water heat recovery apparatus. In a further feature, the first and second tube bundles are connected to cause fresh water to descend in the respective arrays of heat exchange pipes during operation of the gray water heat recovery apparatus. In another feature the shell includes at least a first gray water return connected to convey gray water between a bottom end of one of the first and second gray water passes and the top end of the other of the gray water passes.

In still another feature, the cylindrical shell includes a first gray water down pipe, the first gray water down pipe having a first end at the top end of the cylindrical shell and a second end at the bottom end of the cylindrical shell. the first end receives water from the gray water inlet, and the second end of the first down pipe feeds the first gray water pass. In an additional feature, the first gray water down pipe is located between the first and second gray water passes. In a further additional feature, the first gray water down pipe has a cross-section of irregular shape. In a further feature, the cylindrical shell includes a second gray water down pipe, the second gray water down pipe having a first end at the top end of the cylindrical shell and a second end at the bottom end of the cylindrical shell. the first end of the second down pipe receives water from the first gray water pass, and the second end of the second down pipe feeds the second gray water pass. In yet another feature, the first and second gray water down pipes are located side-by-side between the first and second gray water passes. In another feature, the first and second gray water passes have respective regular-shaped peripheries, the shell has at least first and second joining webs extending between and connecting the first and second gray water passes, and the first gray water down pipe located between the first and second joining webs. In yet another feature, the first and second gray water passes have a cross-section of a cylindrical body of revolution. the shell has first and second tangent members that extend tangentially between the first and second cylindrical bodies of revolution, and the first gray water down pipe is located between the first and second tangential webs. In still another feature, there is a second gray water down pipe, and it is located between the first and second gray water passes and between the first and second tangential webs beside the first gray water down pipe.

In another feature, at least one of the gray water passes has a bottom valve movable between open and closed positions to permit flushing of the respective first and second gray water passes. In an additional feature, the apparatus includes a three-way valve operable between a first position closing the first and second gray water passes from each other. a second position opening the first and second gray water passes to exhaust to a drain. and a third position opening the first and second gray water passes to permit cleanout. In a further feature, the first and second gray water passes are in fluid communication at their respective bottom ends to form a unified sump. In another feature, the apparatus includes a leak detection circuit. In still another feature, the gray water inlet fittings and outlet fittings slide axially into slots formed in the peripheral wall of the shell. In yet a further feature, the shell is wrapped in thermal insulation. In still another feature the shell is formed of extruded plastic.

In a further feature, each of the first and second cylindrical passes is predominantly upstanding and has a bottom end closure, a top end closure, and a return. Each of the first portion and the second portion of the fresh water flow path has first and second terminations, and the first and second terminations pass through the top end closure of the first and second cylindrical plastic pipes, respectively. The top end closures of the first and second cylinders is higher than the drain outlet of the gray water flow path. The first and second cylindrical passes and the first and second tube bundles extend downwardly of the drain outlet whereby the passes define first and second sump portions. The first and second tube bundles are predominantly submerged in the first and second sump portions. In still another feature, there is, in combination, the heat recovery apparatus and a water heater. The fresh water flow path of the gray water heat recovery apparatus is upstream of the water heater. The water heater has supply conduits to at least a first hot water load, and the gray water flow path of the heat recovery apparatus receives gray water from at least the first hot water load.

In another feature, the apparatus has a space filling member positioned to reduce flow path area of the gray water. In a further feature, the apparatus has at least one return mounted within an obstructing member. The gray water is restricted to flow in an annular region outside the obstructing member. In another feature, both the outlet and the inlet are located at one end of the tube bundle whereby the tube bundle may be extracted from one end of the apparatus as a single modular unit. In an additional feature, the inlet header is mounted concentrically about the return, said return passing though said inlet header.

In another aspect of the invention, there is a gray water heat recovery apparatus in which to transfer heat between a gray water stream and a fresh water stream. It has a heat exchanger that has a first pass and a second pass, the first pass and the second pass is connected in series. The heat exchanger has a first side defining a gray water flow path, and a second side defining a fresh-water flow path. The gray water and fresh water paths are segregated from each other. The gray water flow path is a gravity-feed flow path. The fresh water flow path is a pressure-feed flow path. The heat exchanger has a gray water flow path inlet and a gray water flow path outlet. At least a portion of one of the first pass and the second pass is lower than the gray water flow outlet whereby the heat exchanger defines at least a first gray water sump. At least one of the first second passes has a first cylindrical pipe member through which to conduct the gray water stream, defining a containment wall of at least a portion of the gray water flow path. The first cylindrical pipe member has a gray water inlet and a gray water outlet. The first cylindrical pipe member has a first end, and a first end member, the first end member defining a closure of the first end of the first cylindrical pipe member. A first fresh water flow element is nested within the first cylindrical pipe member. It extends axially within the first cylindrical pipe member. The first fresh water flow element has an inlet and an outlet. Both the fresh water inlet and the fresh water outlet are mounted to pass through the first end member of the first cylindrical pipe member.

In a feature of that aspect of the invention, the fresh water flow element has first and second end connections that pass through the first end of the first cylindrical pass. In another feature, the apparatus is mounted adjacent to a water heater. The water heater has an overall height, and the heat recovery apparatus has an overall height. The overall height of the heat recovery apparatus is in the range of 2/3 to 3/2 of the height of the water heater. In a further feature, one of: (a) the first pass and the second pass are connected to define a single gray water sump in which the gray water outlet of the first pass is connected to a lower portion gray water entry of the second pass; and (b) the first pass and the second pass are connected to define a first gray water sump in the first pass and a second gray water sump in the second pass, in which the outlet of the first sump is carried to a top portion entry into the second sump. In another feature, the gray water heat recovery apparatus is connected as a fresh water pre-heater for the water heater.

In another feature, there is the gray water heat recovery assembly in combination with a gray water drainage system, a water heater, and a hot water distribution system. The fresh water inlet of the heat exchanger is connected to a fresh water supply system downstream of a water meter. The fresh water outlet of the heat exchanger is connected to an inlet of the water heater. The water heater has an outlet connected to supply water to at least one of a hot water tap, a shower, a bath-tub, a clothes washer, and a dishwasher. The gray water drainage system is connected to a drain of at least one of a sink; a shower, a bath-tub, a clothes washer, and a dishwasher. The gray water drainage system is segregated from any sewage water system. The gray water drainage system is connected to the gray water inlet of the first cylindrical plastic pipe. The gray water drainage system includes an overflow bypass of the heat exchanger. There is a gray water inlet filter mounted to intercept objects in the gray water carried by the gray water drainage system to the heat exchanger. The outlet of the second cylindrical plastic pipe drains into a sewage drain.

In another feature of any of the foregoing aspects, the apparatus is enclosed in a unitary cylindrical housing in which both of the first and second (and any other) stages are enclosed. Externally accessible gray water and fresh water connection fittings pass through the external cylindrical housing. The fresh water connection fitting extends through a top end of the cylindrical housing. The gray water connection fittings extend through a sidewall of the cylindrical housing.

In another aspect of the invention, there is a gray water heat recovery apparatus. It has a heat exchanger having at least a first pass and a second pass, mounted in series. The heat exchanger has a gravity-fed gray water flow path, the gray water flow path including a first portion in the first pass, and a second portion in the second pass, the first portion in the first pass being upstream of the second portion in the second pass, the gray water flow path having a source inlet, and a drain outlet. The gray water flow path has an intermediate portion lower than the drain outlet. The heat exchanger has a pressure-fed fresh water flow path, the fresh water flow path being segregated from the gray water flow path. The fresh water flow path has a first portion in the second pass, and a second portion in the first pass, the second portion of the fresh water flow path being downstream of the first portion of the fresh water flow path. The fresh water flow path of the heat exchanger is at least predominantly immersed in the gray water flow path. The fresh water flow path has a fresh water source and a fresh water outlet, both the fresh water source and the fresh water outlet being positioned at respective heights higher than the drain outlet of the gray water flow path. The heat exchanger is free of fresh water wall penetrations of the gray water flow path lower than the drain outlet of the gray water flow path. There is a non-electrically conductive barrier between the gray water flow path and the fresh water flow path.

In a feature of that aspect of the invention the apparatus has a leak detection circuit. In another feature, the leak detection circuit has at least a first terminal mounted in the fresh water flow path, and at least a second terminal mounted in the gray water flow path. The leak detection circuit senses at least one of (a) resistance; and (b) voltage potential between the fresh water flow path and the gray water flow path. The leak detection circuit includes a storage member operable to provide power independently of external power.

In still another feature, the leak detection circuit is operable to adjust the flow of at least one of (a) gray water in the gray water path; and (b) fresh water in the fresh water path. In another feature, the apparatus includes a fresh water bypass, and flow through the fresh water bypass is controlled in response to operation of the leak detection circuit. In still another feature, the apparatus includes a gray water bypass, and flow through the gray water bypass is controlled in response to the leak detection circuit.

In another feature, the first pass and the second pass are of substantially the same size and are mounted side-by-side. The first pass includes a first shell defining an outer wall of a first portion of the gray water flow path. The second pass includes a second shell defining an outer wall of a second portion of the gray water flow path. The first portion of the fresh water flow path is nested within the second shell. The second portion of the fresh water flow path is nested within the first shell. The first shell has a resting sump fluid level, and the second portion of the fresh water flow path has an entrance to and an exit from the first shell, both of the entrance and the exit being at a level at least as high as the resting sump fluid level. The first shell has at least a first closure fitting; the second portion of the fresh water flow path has an entrance to and an exit from the first shell; both of the entrance and the exit being carried through the first closure fitting.

In another feature, the apparatus includes a leak detection circuit. The leak detection circuit includes at least a first terminal mounted in the fresh water flow path, and at least a second terminal mounted in the gray water flow path lower than a resting water level therein. The leak detection circuit is sensitive to a change in resistance between the fresh water flow path and the gray water flow path. The leak detection circuit includes a storage member operable to provide power independently of the availability of external power. The leak detection circuit is operable to adjust the flow of at least one of (a) gray water in the gray water path; and (b) fresh water in the fresh water path.

BRIEF DESCRIPTION OF THE ILLUSTRATIONS

Figure 2A:
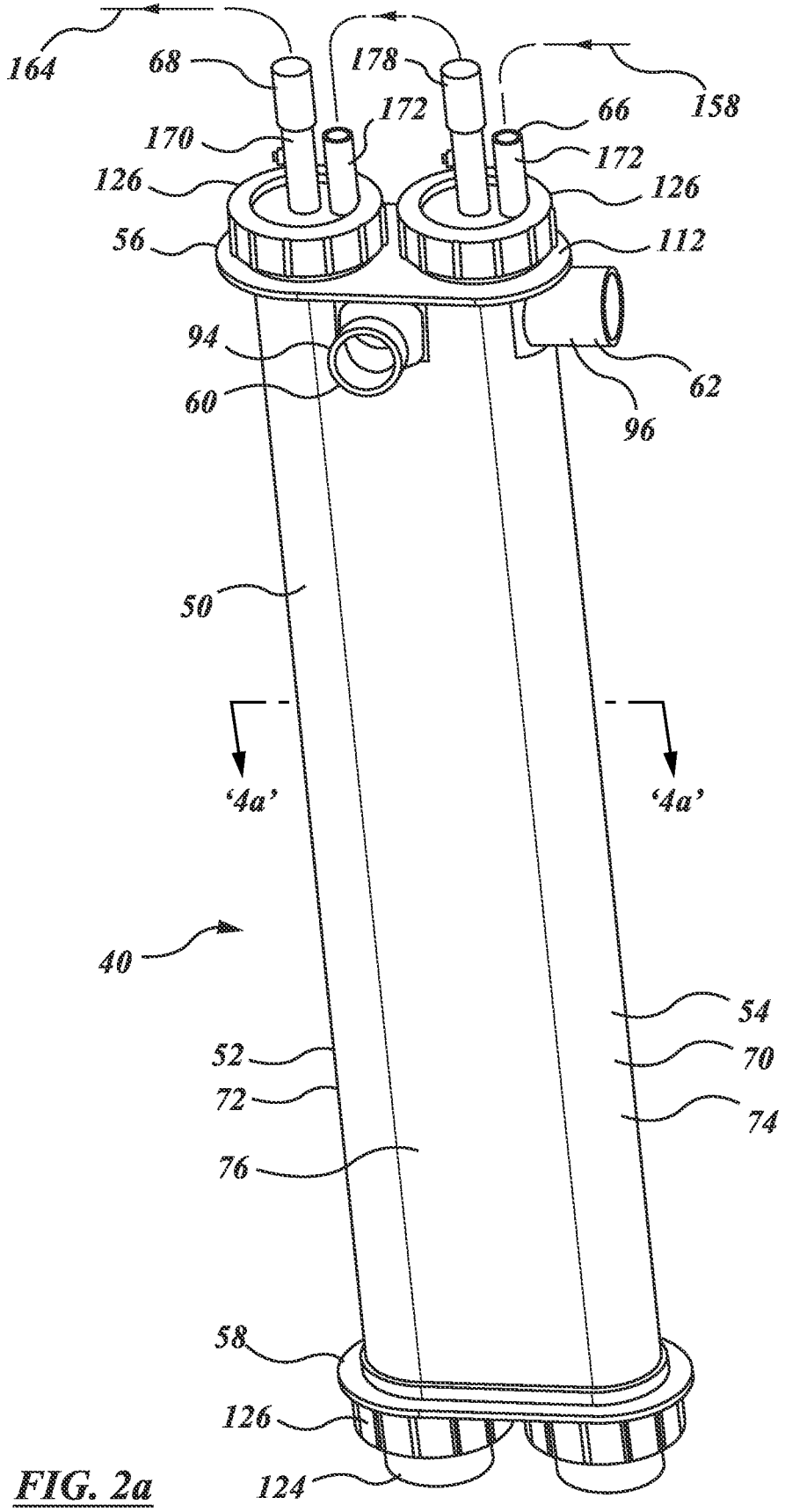
Figure 2C:
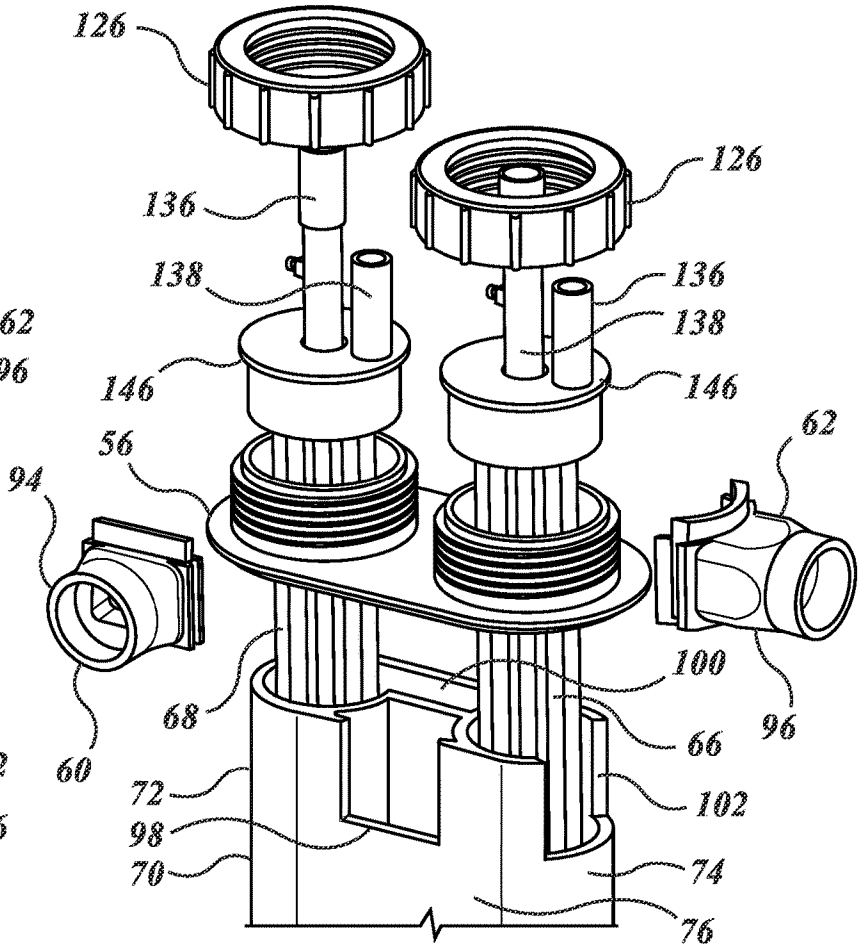
Figure 2B:
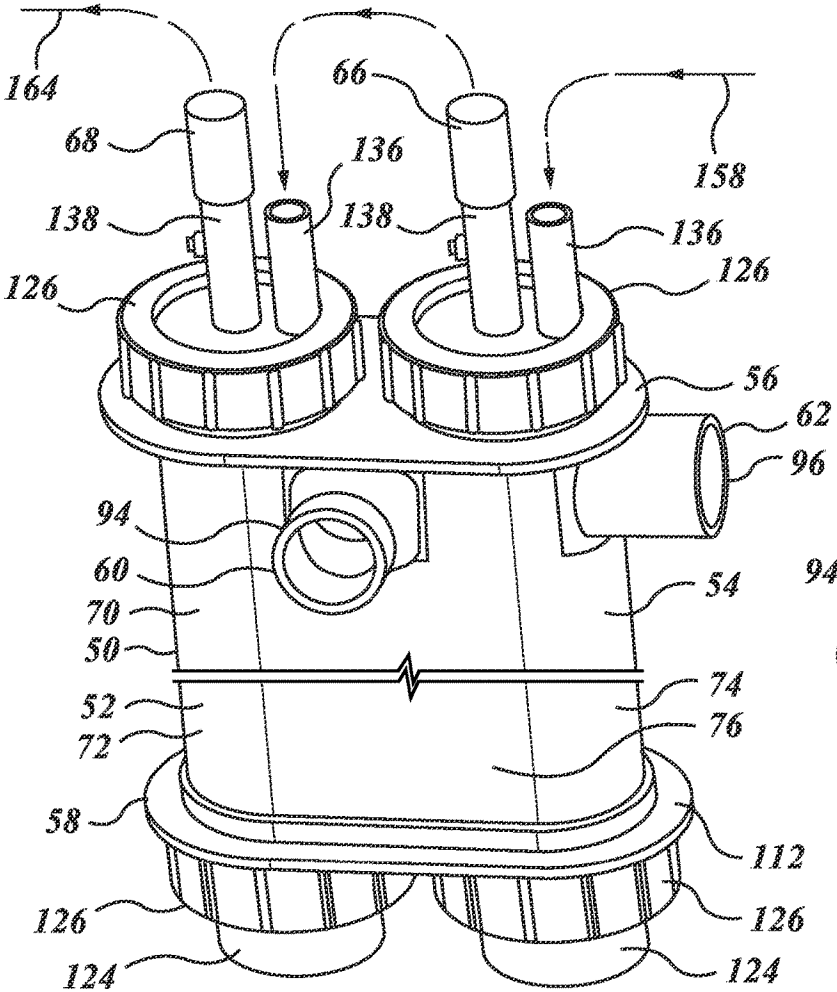

These and other features and aspects of the invention may be explained and understood with the aid of the accompanying illustrations, in which:

FIG. 1 is a conceptual schematic view of a building, such as a residence, having gray water sources;

FIG. 2*a* is a perspective general arrangement view of a heat exchanger arrangement, with external thermal insulation removed for use in the building of FIG. 1;

FIG. 2*b* is a fore-shortened enlarged perspective view of the heat exchanger arrangement of FIG. 2*a;*

FIG. 2*c* is an exploded view of the upper end of the arrangement of FIG. 2*b;*

Figure 2E:
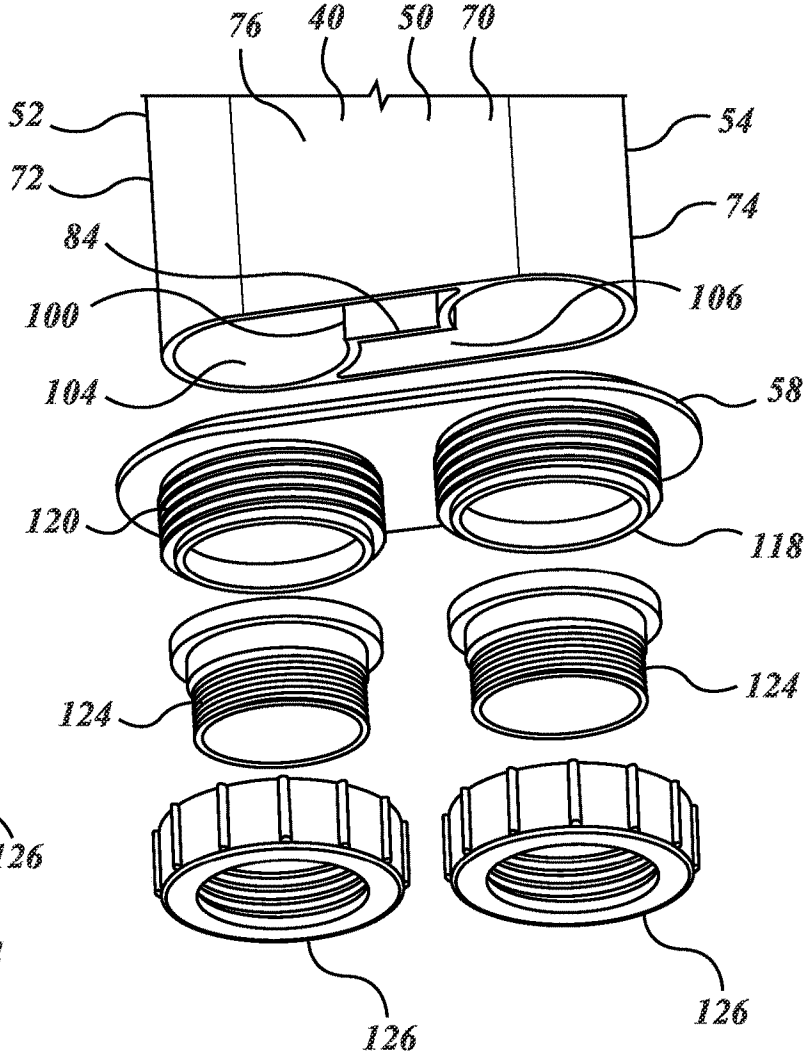
Figure 2D:
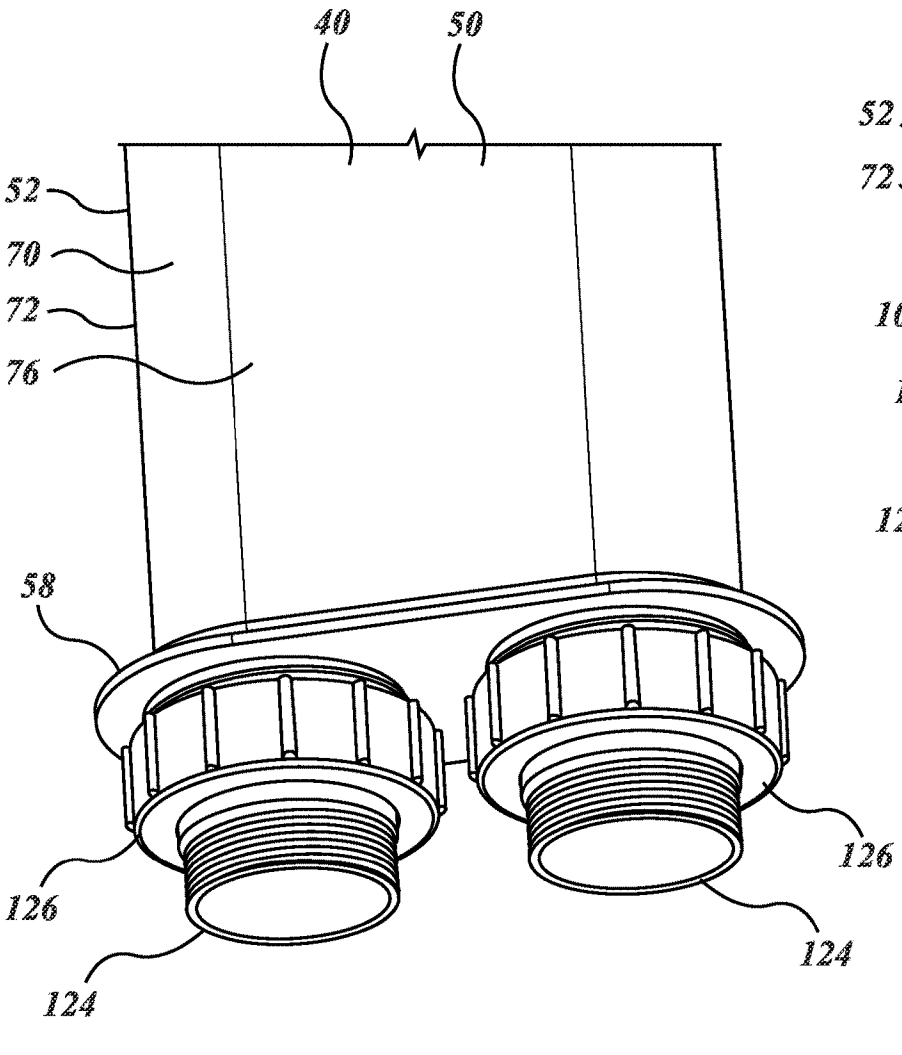

FIG. 2*d* is an enlarged view of the bottom end of the arrangement of FIG. 2*b;*

FIG. 2*e* is an exploded view of the bottom end of the arrangement of FIG. 2*d;*

Figure 3A:
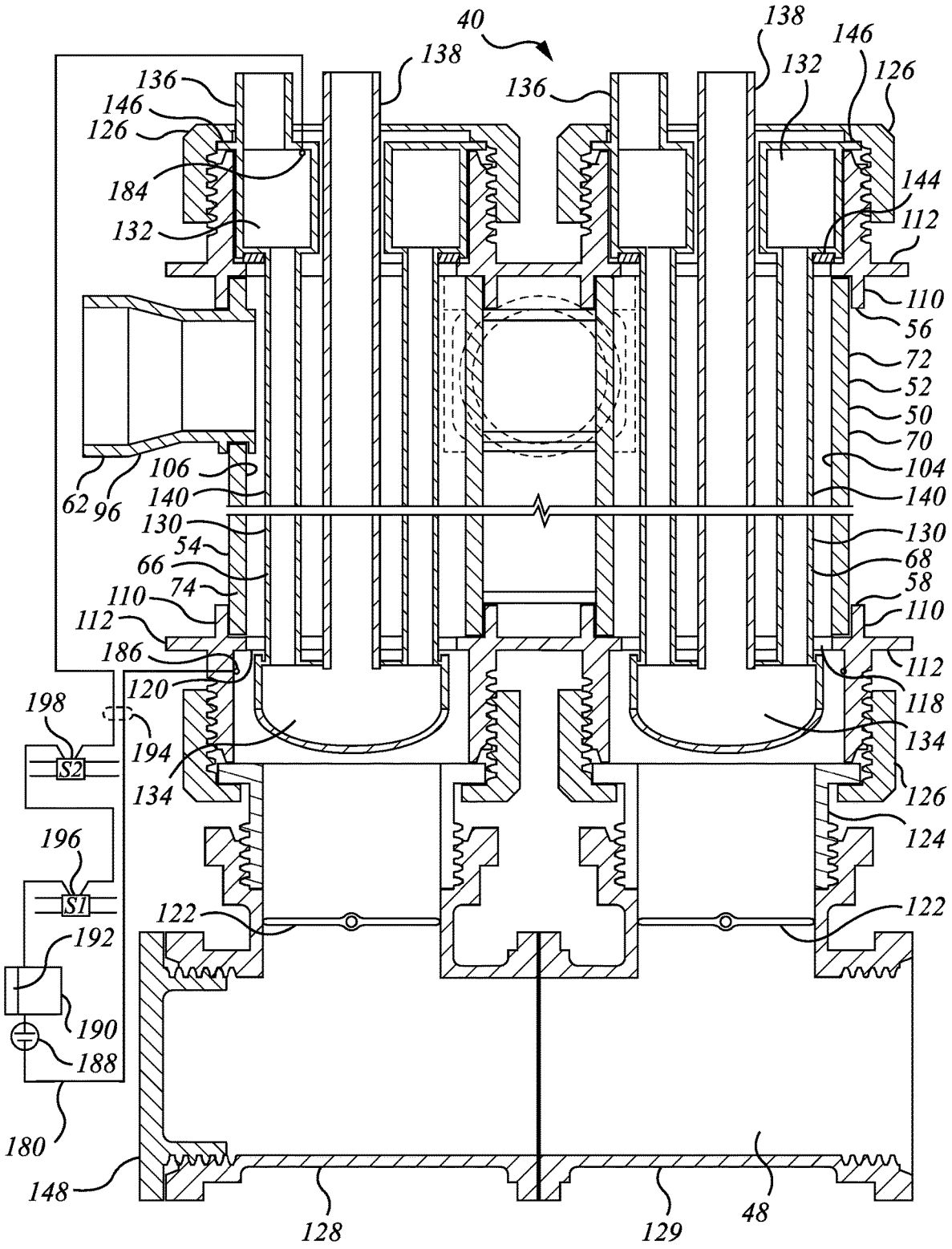

FIG. 3*a* is a view on a staggered section that is in a generally vertical lateral section of the heat exchanger arrangement of FIG. 2*a;*

Figure 3B:
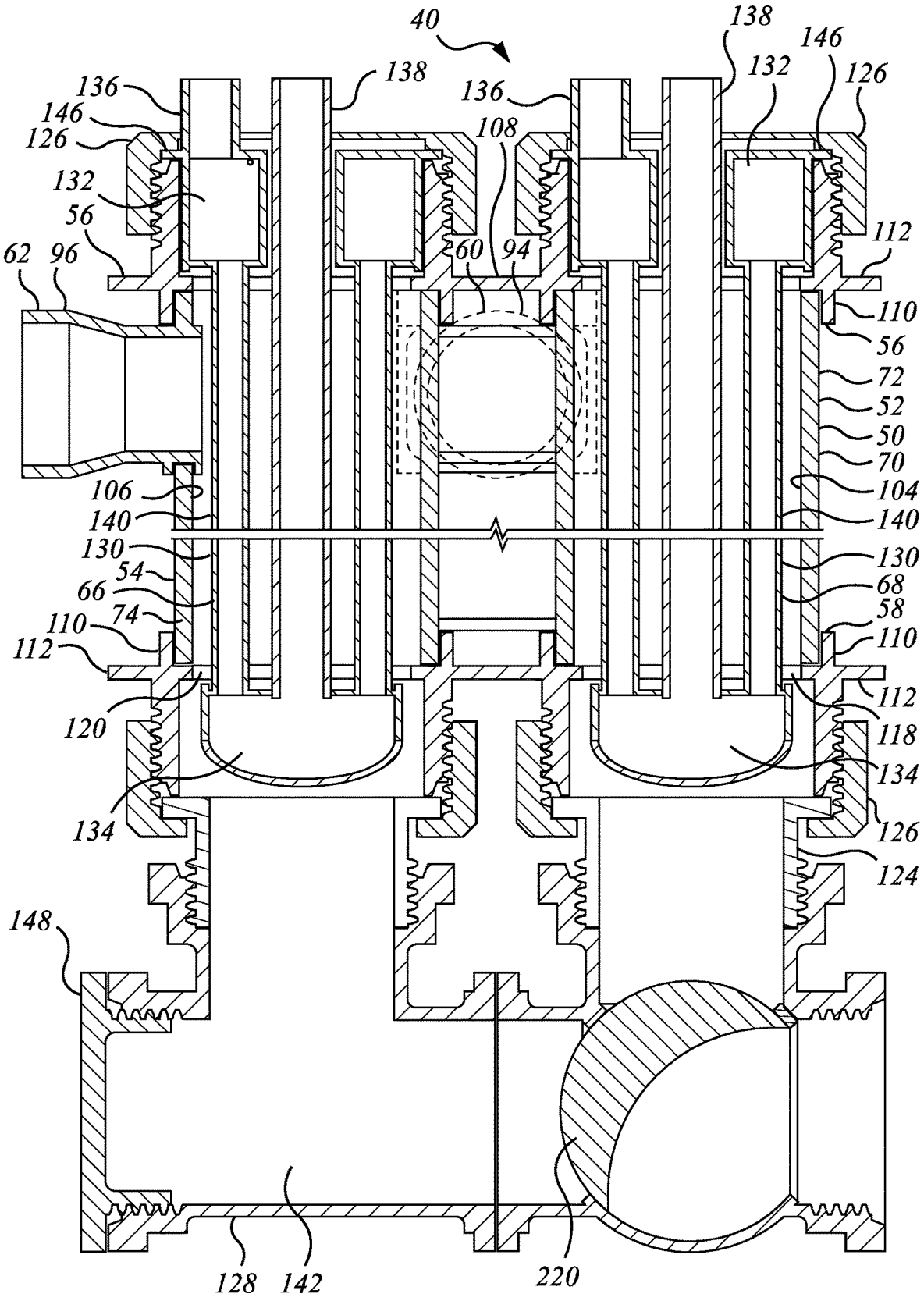

FIG. 3*b* is a cross-sectional view an alternate embodiment to that of FIG. 3*a;*

Figure 3C:
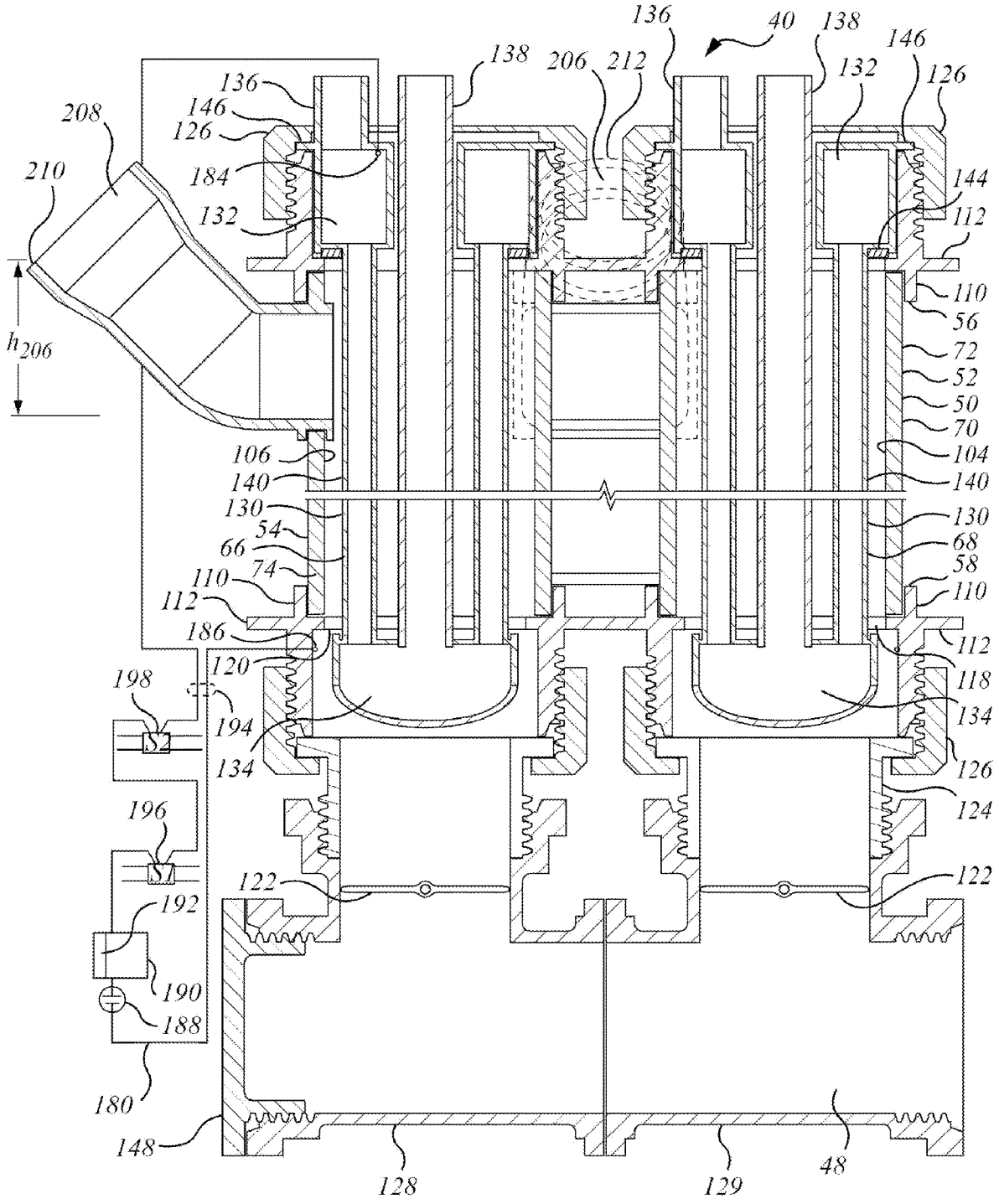
Figure 4A:
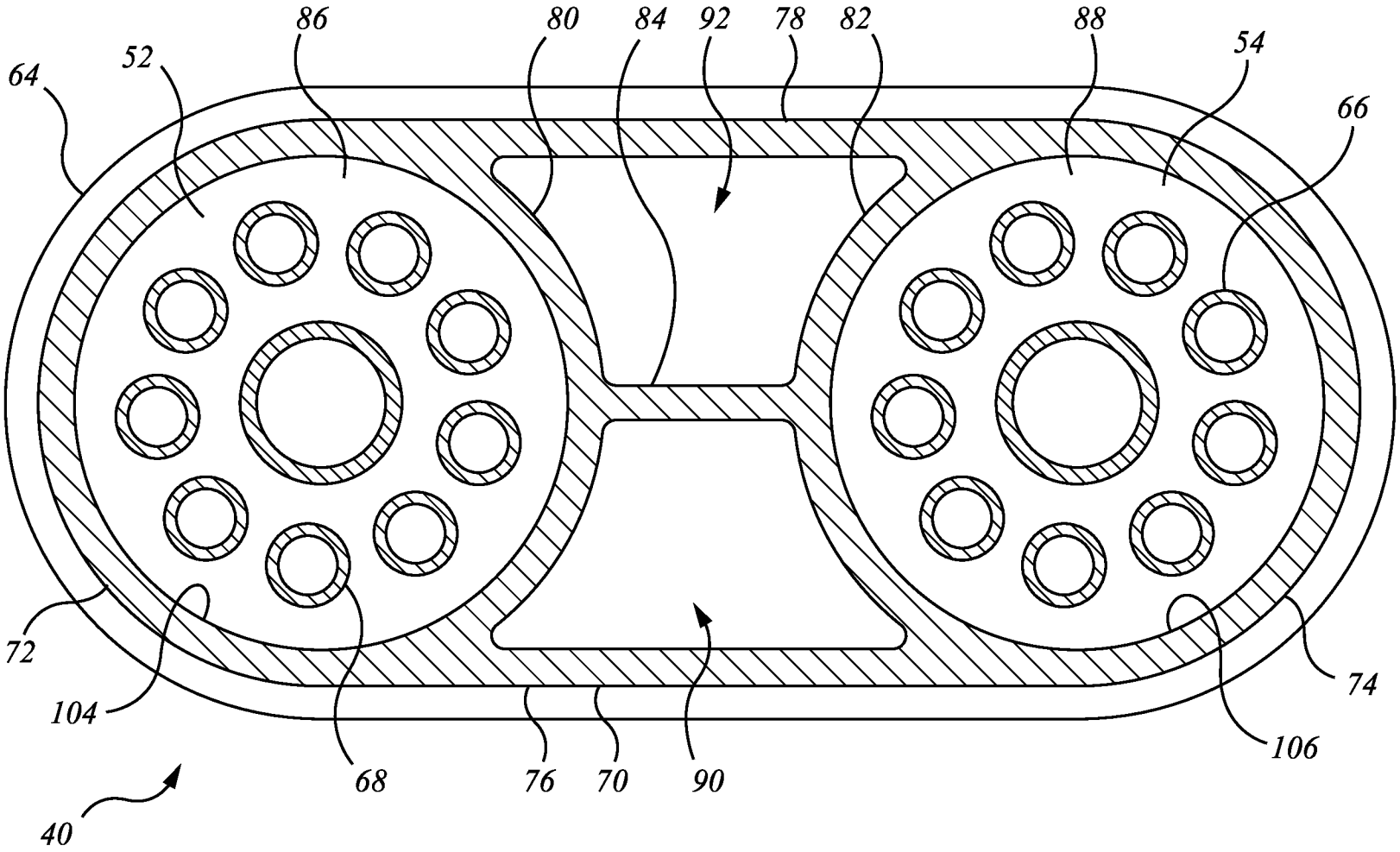
Figure 4B:
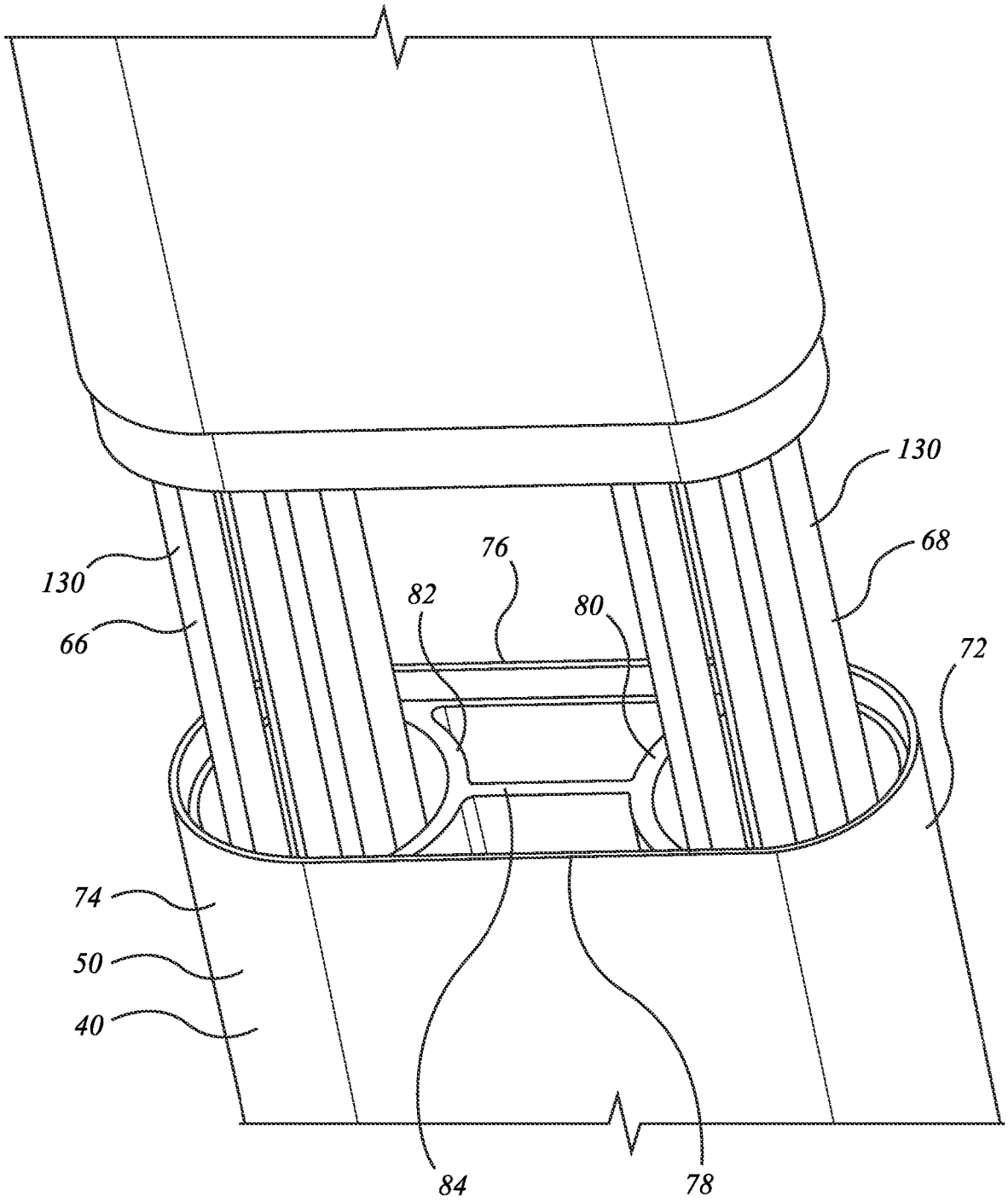

FIG. 3*c* shows an alternate embodiment to that of FIG. 3*a* having inlet and outlet gray water port fittings have spouts that are tilted upwardly;

FIG. 4*a* is a horizontal cross-section of the heat exchanger arrangement of FIG. 2*a* at mid-height;

FIG. 4*b* is a perspective view of a partially opened perspective view of the arrangement of FIG. 4*a;*

Figure 4C:
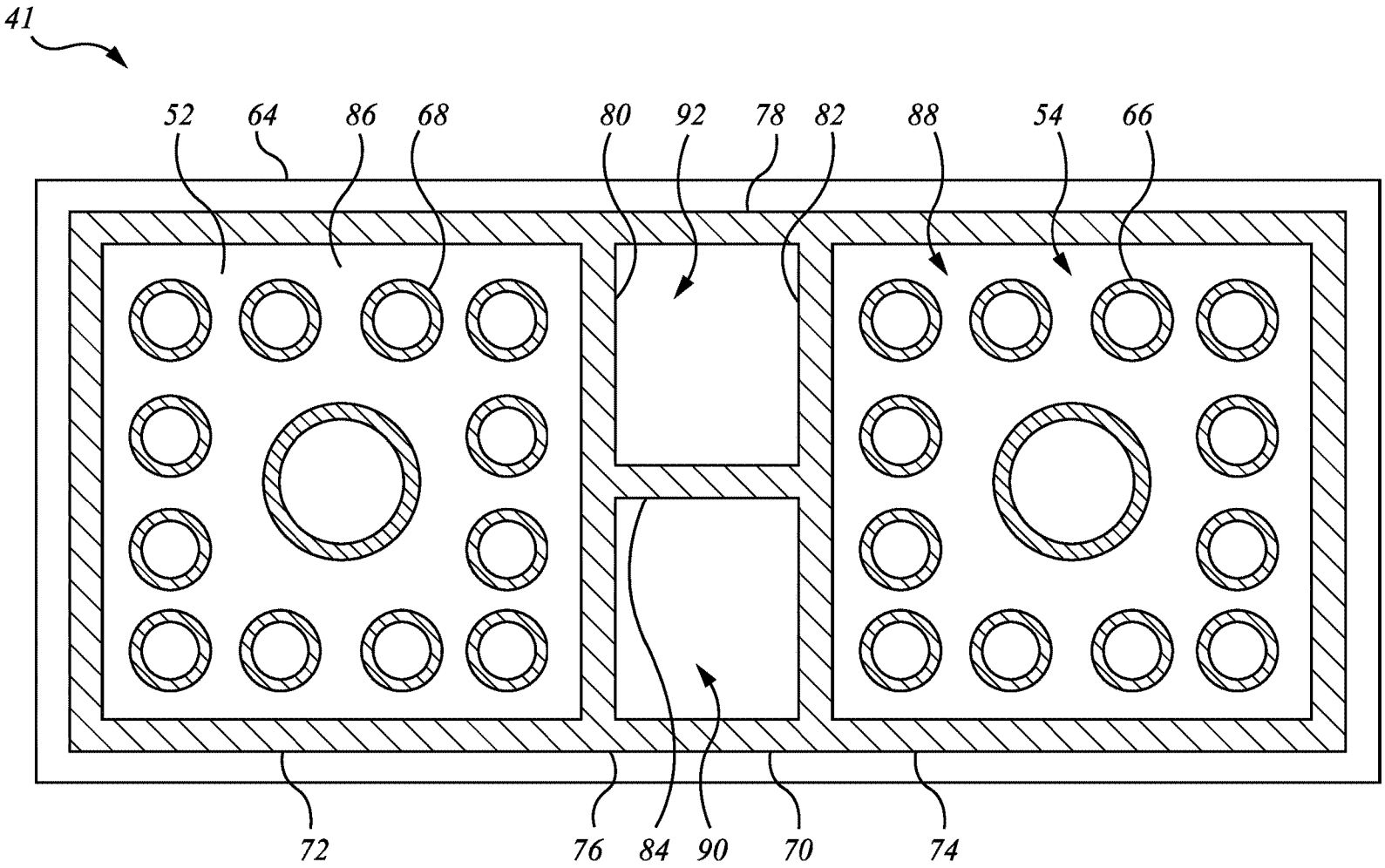

FIG. 4*c* shows an alternate, rectilinear form of arrangement to that of FIG. 4*a;*

Figure 5A:
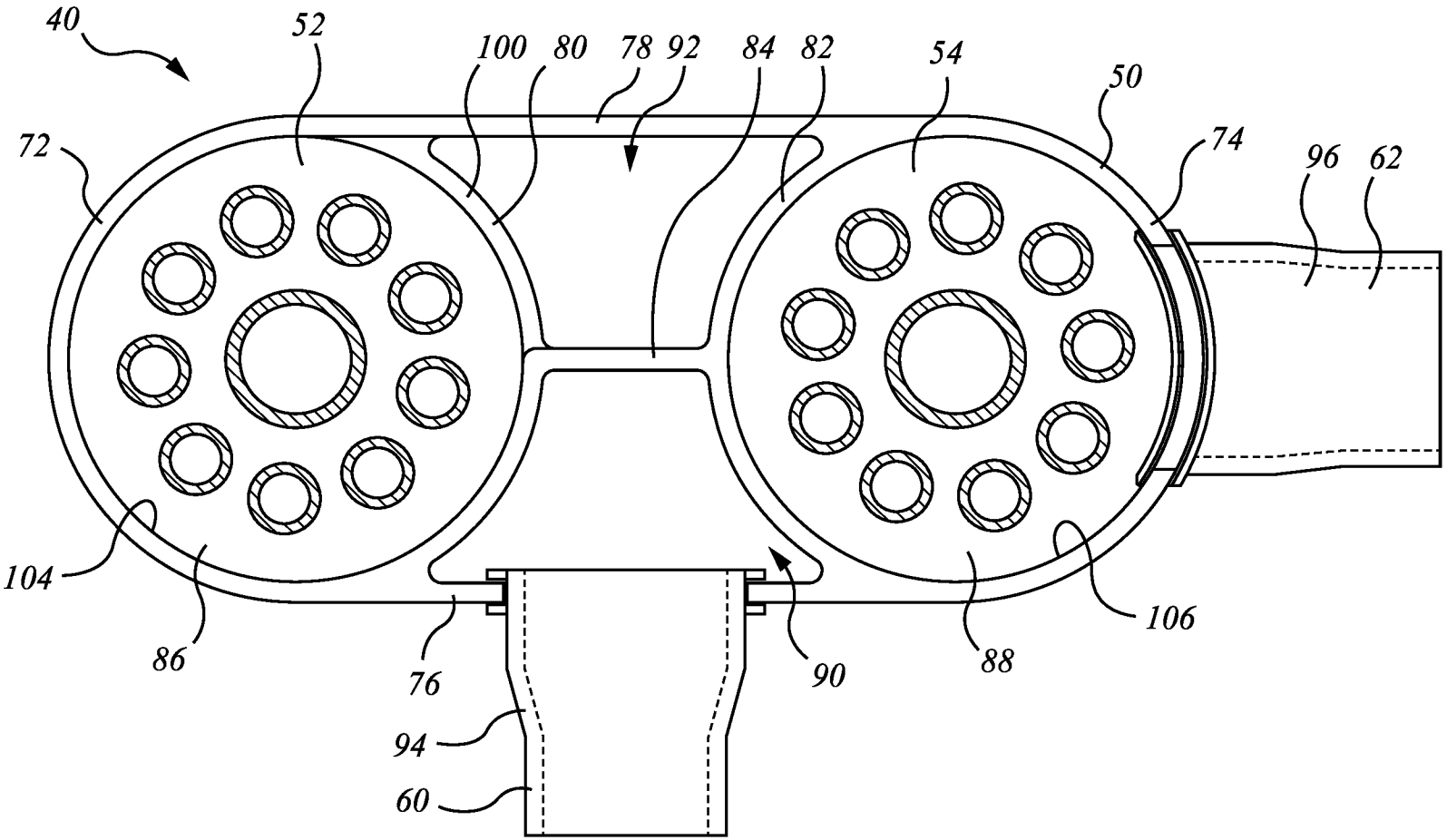
Figure 5B:
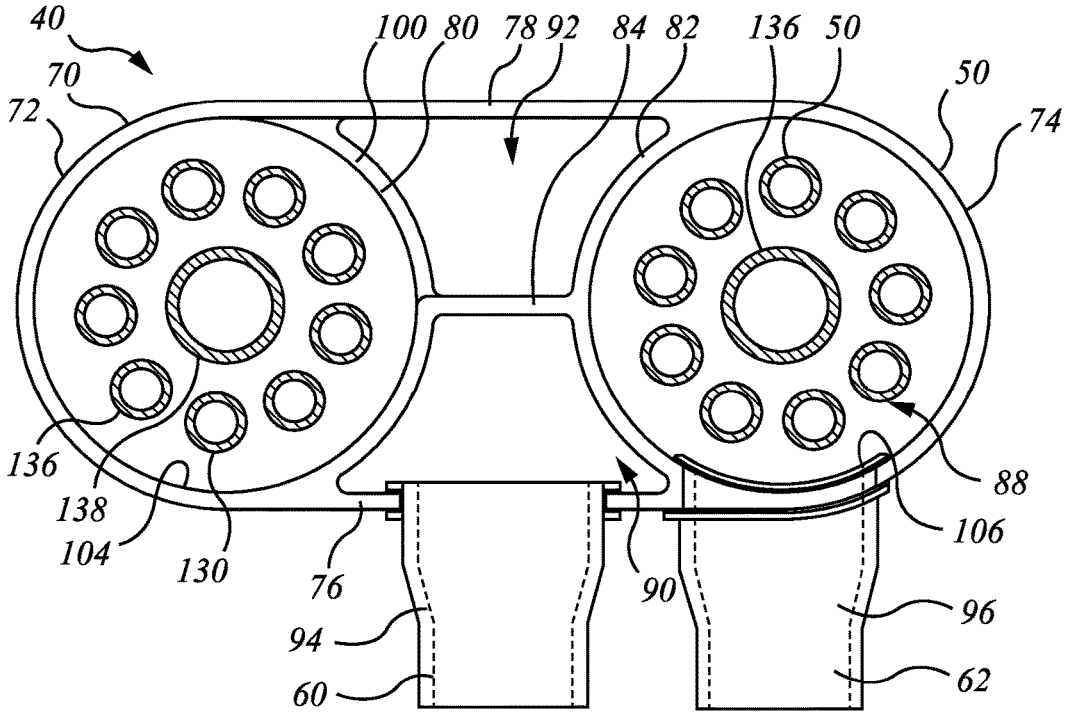

FIG. 5*a* is a top view of the heat exchanger arrangement of FIG. 2*a* worth the top panel removed;

FIG. 5*b* is a top view of an alternate embodiment to that of FIG. 5*a;*

Figure 5F:
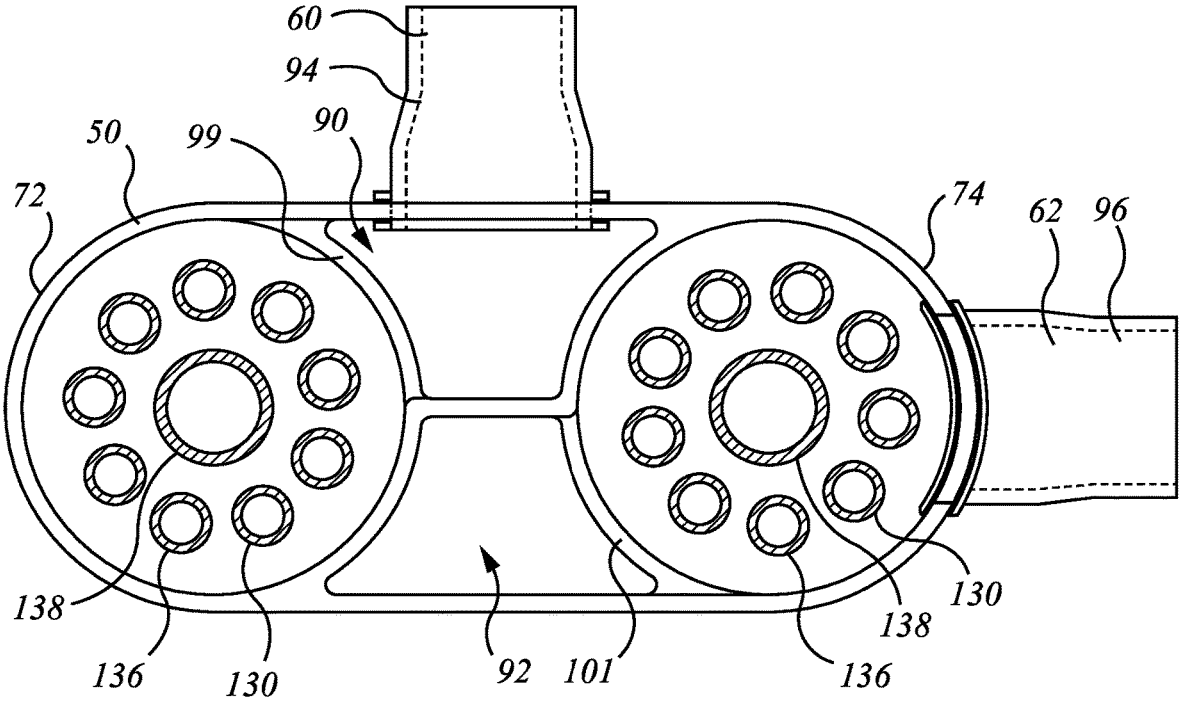
Figure 5C:
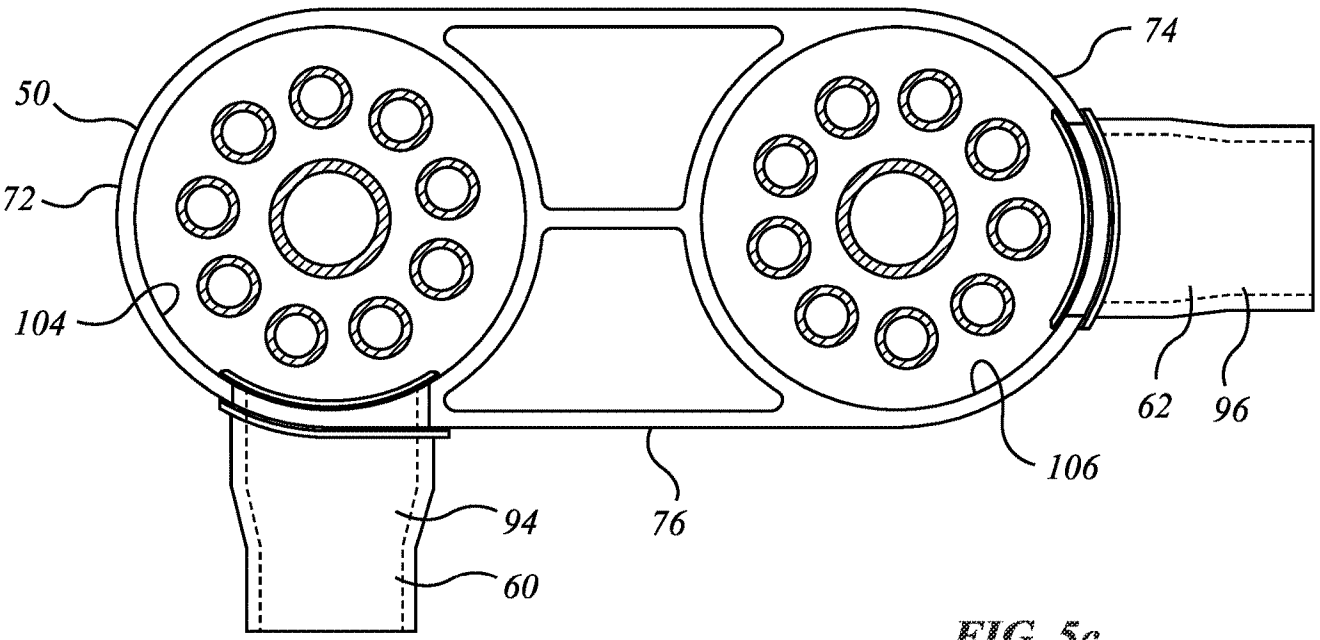

FIG. 5*c* is a top view of another alternate embodiment to that of FIG. 5*a;*

Figure 5E:
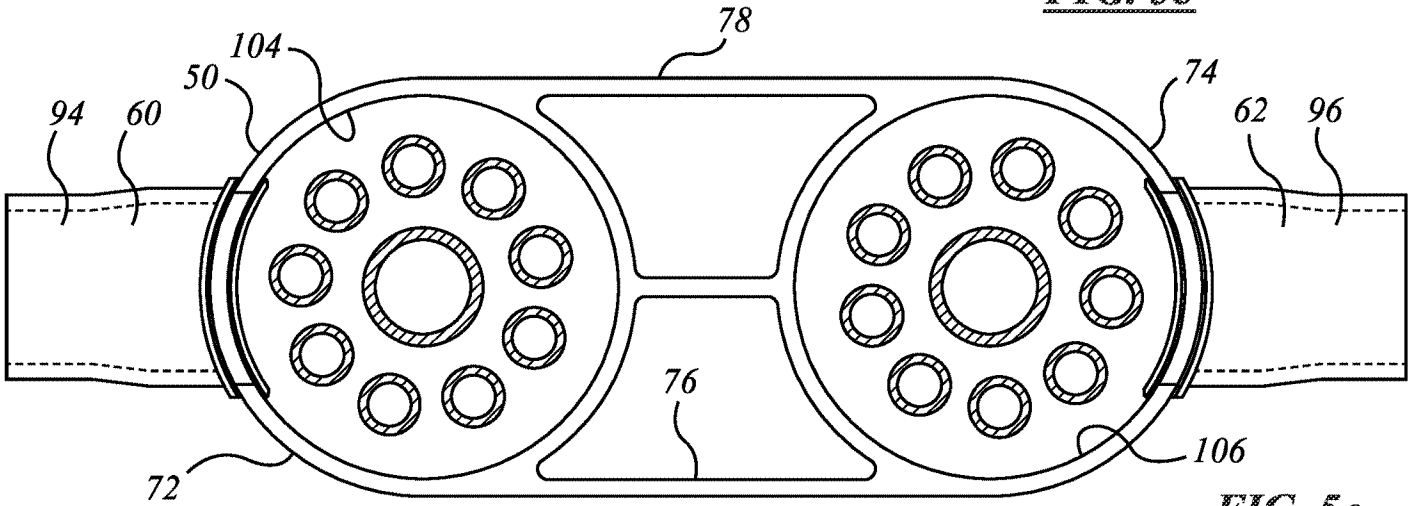
Figure 5D:
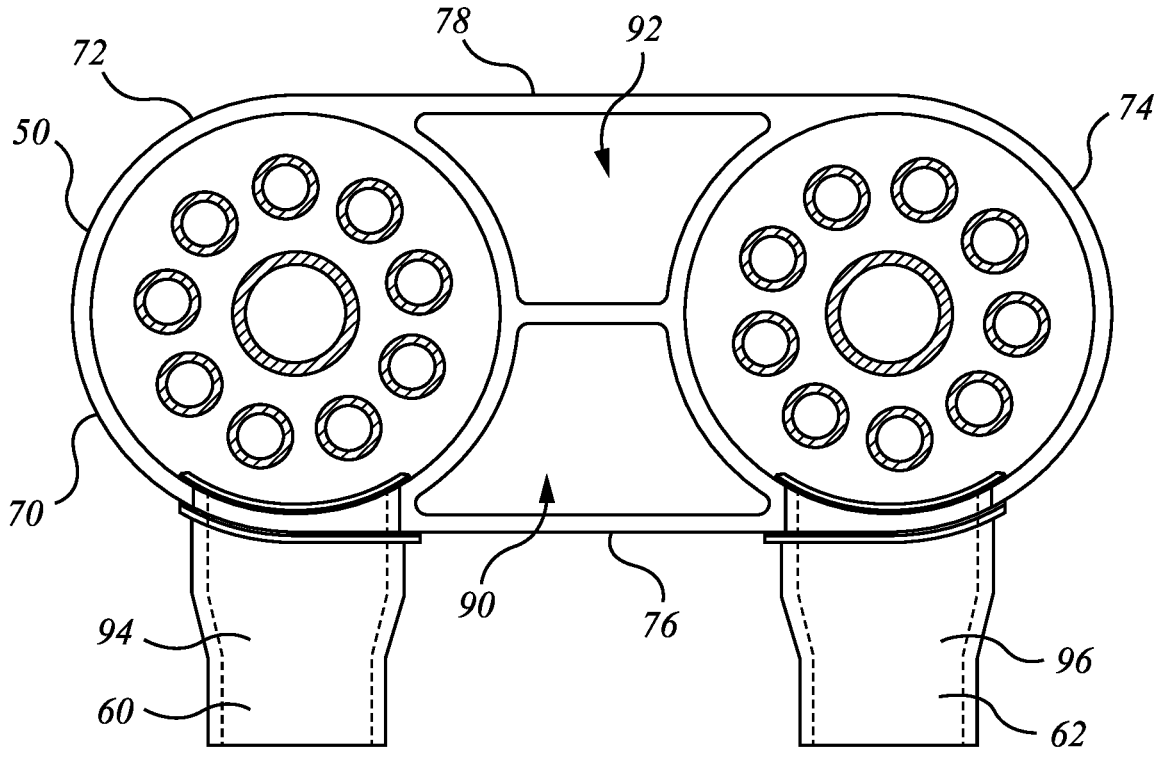

FIG. 5*d* is a top view of yet another alternate embodiment to that of FIG. 5*a;*

FIG. 5*e* is a top view of an alternate embodiment to that of FIG. 5*d;*

FIG. 5*f* is a bottom view of the arrangement of FIG. 5*a* or 5*b;*

Figure 5G:
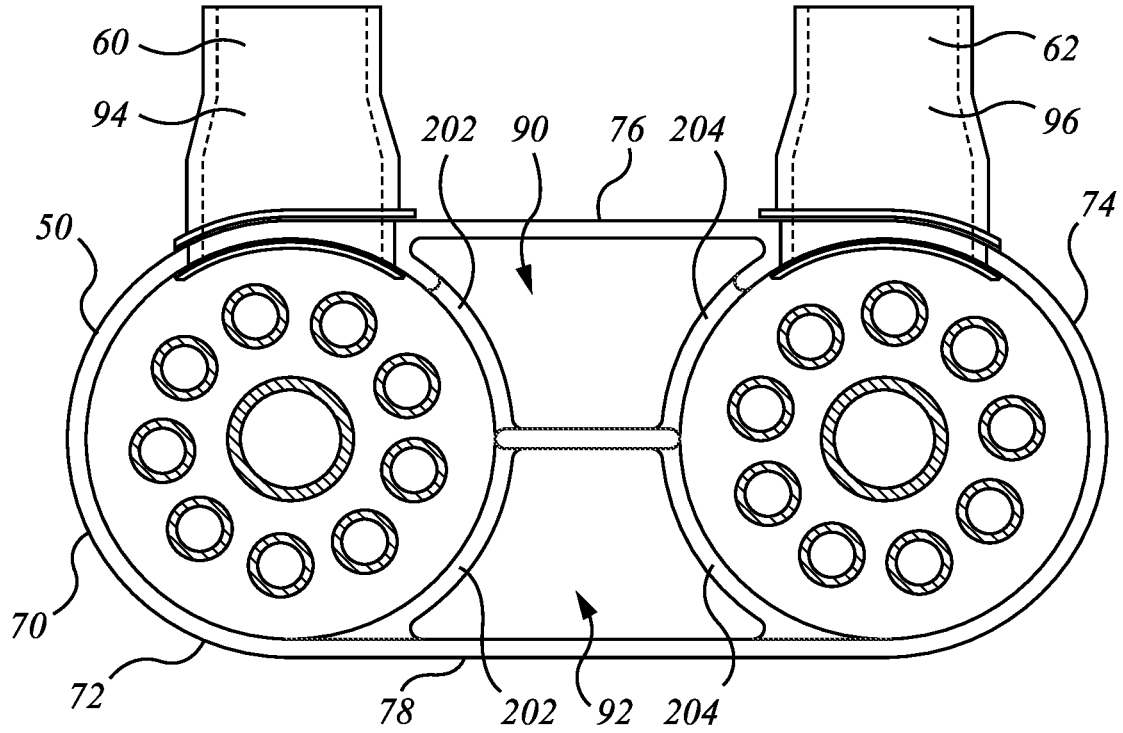

FIG. 5*g* is a bottom view of the arrangement of FIG. 5*c* or 5*d;*

Figure 5H:
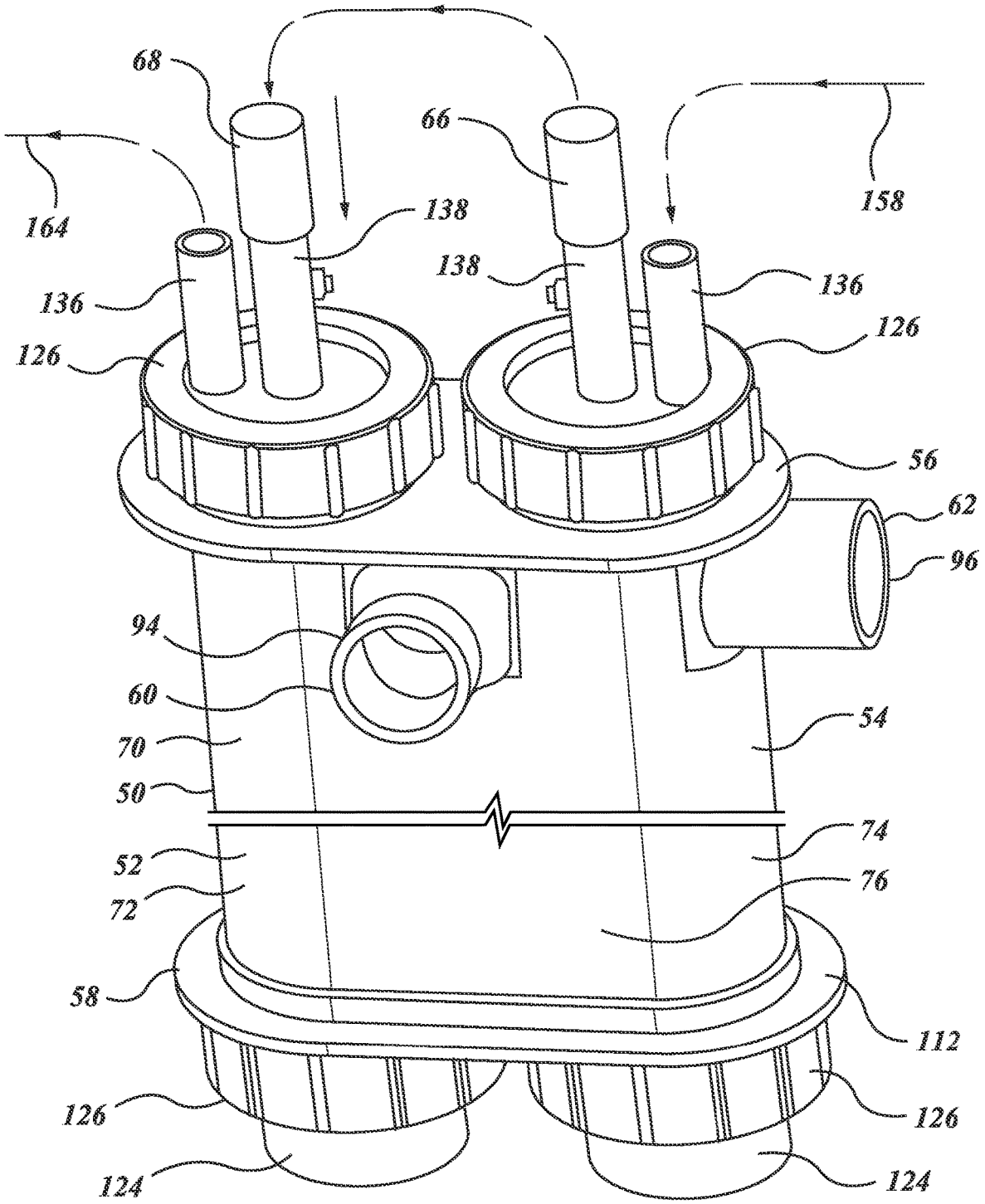

FIG. 5*h* is a view analogous to FIG. 2*b* of the arrangement of FIG. 5*g;*

Figure 6A:
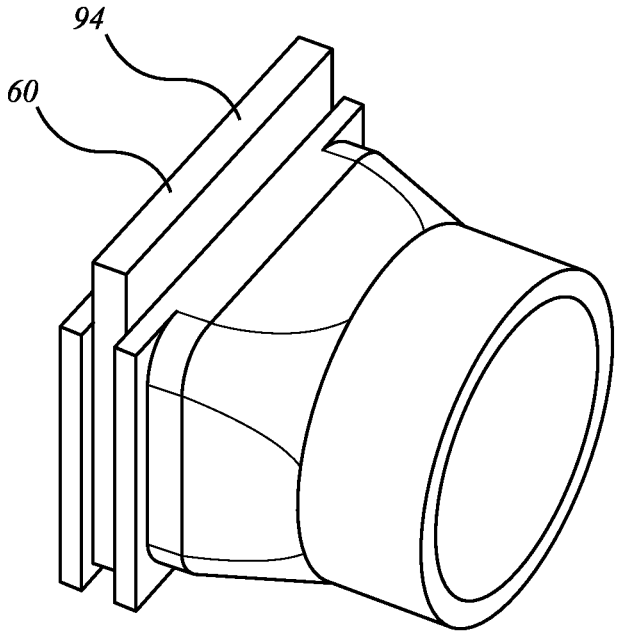

FIG. 6*a* is a perspective view of a gray water port of the heat exchanger arrangement of FIG. 2*a;*

Figure 6B:
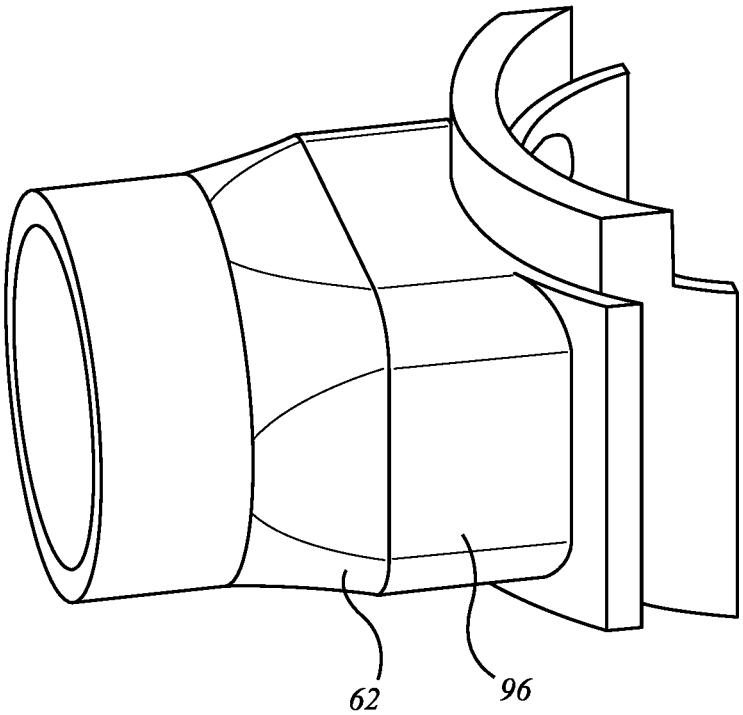

FIG. 6*b* is a perspective view of another gray water port of the heat exchanger arrangement of FIG. 2*a;*

Figure 7A:
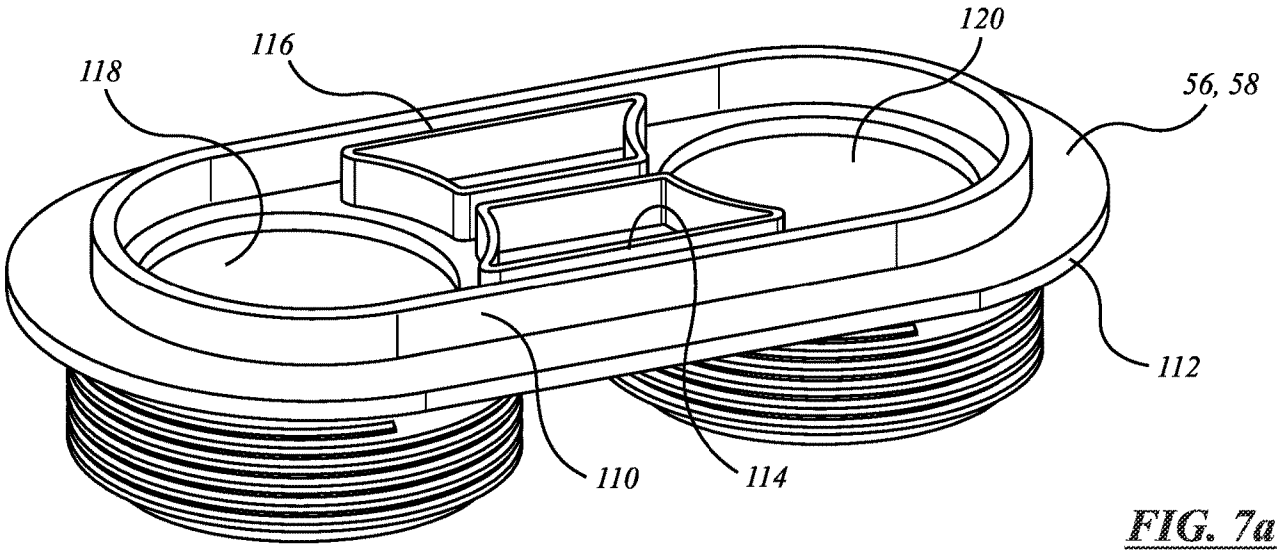
Figure 7B:
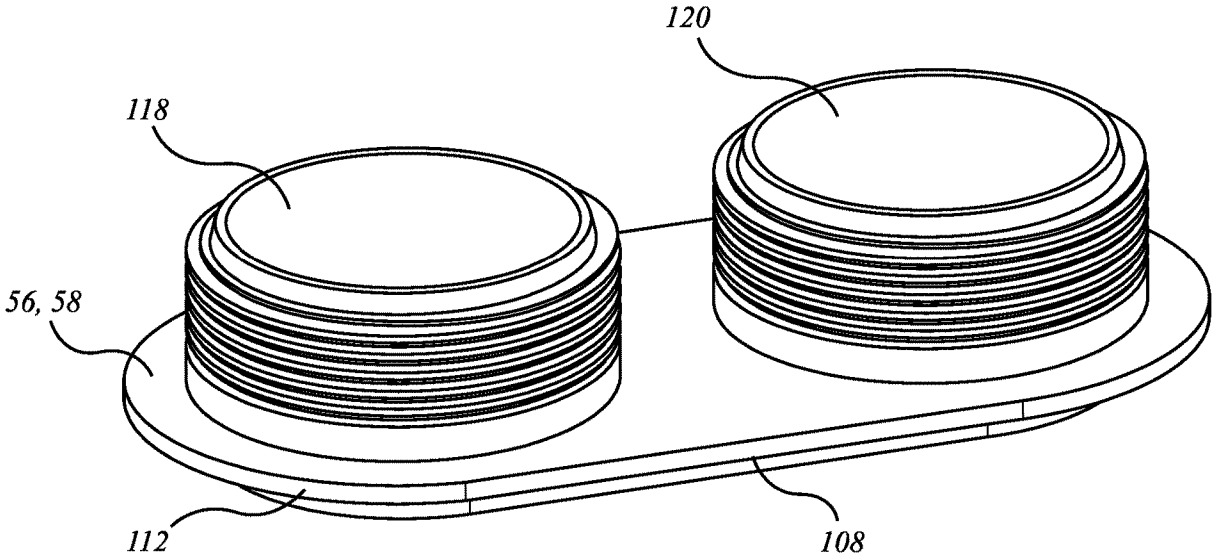

FIG. 7*a* is a perspective view of an end cap fitting of the heat exchanger arrangement of FIG. 2*a*; and FIG. 7*b* is an opposite perspective view of the end cap of FIG. 7*a.*

DETAILED DESCRIPTION

The description that follows, and the embodiments described therein, are provided by way of illustration of an example, or examples, of particular embodiments incorporating one or more of the principles, aspects and features of the invention. These examples are provided for the purposes of explanation, and not of limitation, of those principles, aspects and features. In the description, like parts are marked throughout the specification and the drawings with the same respective reference numerals. The drawings may be taken as being to scale, or generally proportionate, unless indicated otherwise. In the cross-sections, the relative thicknesses of the materials may not be to scale.

The scope of the invention herein is defined by the claims. Though the claims are supported by the description, they are not limited to any particular example or embodiment. Other than as indicated in the claims, the claims are not limited to apparatus or processes having all of the features of any one apparatus or process described below, or to features common to multiple or all of the apparatus described below. It is possible that an apparatus, feature, or process described below is not an embodiment of any claimed invention. The terminology used in this specification is thought to be consistent with the customary and ordinary meanings of those terms as they would be understood by a person of ordinary skill in the art in North America. The Applicant expressly excludes all interpretations of terminology that are inconsistent with this specification, and, in particular, expressly excludes interpretation of the claims or the language used in this specification such as may be made in the USPTO, or in any other Patent Office, other than those interpretations for which express support can be demonstrated in this specification or in objective evidence of record, demonstrating how the terms are used and understood by persons of ordinary skill in the art generally, or by way of expert evidence of a person of experience in the art.

The discussion may refer to a gravity-based co-ordinate system. In flow systems generally, there is a source or inlet of flow, and an outlet or discharge of flow. Fluid moves from a location of higher pressure or potential to a location of lower pressure or potential. In a fresh water supply system, the source of pressure may be a pump or an accumulator, such as a water tower, used to provide or maintain a desired system head or pressure. A drain system, whether for sewage or for gray water, may be a gravity fed or gravity driven system in which the head of the flow, if any, is determined by the height of the water column of the drain. Such a system may be considered a low, or very low, head system. In either case, the system will have an upstream direction from which flow originates, and a downstream direction toward which flow occurs. In the present description, gravity flow systems may also include septic or other systems where material that collects in the drainage system under gravity is then pumped out, such as, for example, to a holding tank or to a septic bed. In such systems, there may be a separate gray water sump and gray water pump to raise the effluent to a level to reach the holding tank or to flow into the septic bed, as may be.

In this description there are cylindrical objects for which a cylindrical polar co-ordinate system may apply in which the axis of rotation of the body of rotation, or cylinder, as may be, may be considered the axial or x-direction. The perpendicular distance from the x-axis is defined as the radial direction or r-axis, and the angular displacement is the circumferential direction, in which angular distance may be measured as an angle of arc from a datum. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

FIG. 1 establishes the context of the description. There is a building 20. Building 20 may be a residential dwelling, whether a single family home, or multiple unit residence, as may be. It may be a school or office building. However it may be, building 20 may have a water supply system 22, and a drain system 24. Water supply system 22 may include a fresh, cold water supply system, 21, and a fresh hot water supply system 23, such as may be fed from a water heater. Drain system 24 may include a septic or sewer system 26, and may include a gray water system 28. Gray water system 28 is segregated from septic or sewer system 26. Septic or sewer system 26 may be connected to toilets and utility room floor drains, for example, and may have drainage runs, or pipes, that collect at a common manifold, or drain, or riser or stack, indicated generally as 30. In either case, building 20 may have a mechanical or utility room, typically in a basement, or at foundation level.

Gray water system 28 may include one or more sink drains, whether from a washroom sink, or from a kitchen sink, or laundry tub, generically indicated as sink 32; from one or more shower drains, indicated generically as 34; from a kitchen sink or dishwasher drain, indicated generically as 36. These drains connect to a common gray water drain line or manifold, such as may be indicated as 38. Manifold 38 feeds a heat recovery apparatus 40. That is, the gravity driven gray water output or discharge flow of manifold 38 is the gray water input flow of heat recovery apparatus 40.

In FIG. 1, heat recovery apparatus 40 may have an overflow bypass 42 connected to conduct flow arriving from manifold 38 to the main drain 46 in the event that some or all of the gray water input flow does not flow into the heat exchange components of apparatus 40, for whatever reason. Heat recovery apparatus 40 may also include an input filter, or filters, indicated as 44, to exclude solid particles or other objects whose presence or accumulation within the heat exchange elements of apparatus 40 may not be desired. The inlet filter may be placed so that the inflow into unit 40 passes partially or predominantly upward. The element, or elements, of filter 44 may also be removed, cleaned, or replaced from time to time. Ordinary flushing of apparatus 40 may be controlled by a valve, or valves 122. The output of valves 122 leads to main drain 46. Main drain 46 carries effluent below the level of the foundation, or basement floor, either to the municipal sewers, or to a septic tank or bed.

In FIG. 2*a*, heat recovery apparatus 40 has a first stage, or first pass, 52, and a second stage or second pass, 54. These can also be referred to as first gray water pass 52 and second gray water pass 54. Heat recovery apparatus 40 is a heat exchanger (or series of connected heat exchangers), in which each pass is itself a heat exchanger. The stages or passes are connected in series, and in the embodiment of FIG. 2*a* the inputs and outputs on the hot and cold sides, respectively, are connected in opposite directions, such that heat recovery apparatus 40 is a counter-flow heat exchanger.

As a preliminary description, and in distinction to the apparatus described in U.S. Pat. No. 10,775,112, heat recovery apparatus 40 has a unitary cylindrical shell 50. It has a top end cap 56 and a bottom end cap 58. It has an inlet port 60 and an outlet port 62. It has an external wrap of thermal insulation 64 identified in the cross-section of FIG. 4*a*, and, in use, it contains a first tube bundle heat exchanger 66 and a second tube bundle heat exchanger 68. These items are discussed in greater detail below.

Cylindrical shell 50 is a unitary member, i.e., it is a single-piece monolith. It has multiple flow passages. It is cylindrical, having a long axis that, in use, is the vertical axis. As illustrated, cylindrical shell 50 is an extrusion. Its lengthwise-extending internal passageways are cylindrical. It has the form of an oval plastic pipe with internal webs or dividers. That is, it can be thought of as having an external wall 70 having an oval form. The oval has a first end portion 72 in the form of a first semi-circular wall, and a second end wall portion 74 in the form of a second semi-circular wall. The external oval also has respective first and second side portions 76, 78, that extend between, and connect, the respective semi-circular end walls 72, 74. As shown, side wall portions 76, 78 are tangents that merge with the opposed ends of walls 72 and 74. At the first end of the oval there is an internal web 80 that extends across inside one end of the oval as a first divider. There is a second web 82 that extends across the other end of the oval as a second divider. A third web 84 functions as a third divider to split the space between the first and second divider. That space can be split either by running third web 84 in the x-direction to run between side wall portions 76, 78; or in the y-direction to run between first and second webs 80, 82. As shown, first and second webs 80, 82 are the other semi-circular halves that complement the semi-circular wall end portions 72, 74 respectively. Portions 72 and 80 co-operate to form a first circle; and portions 74 and 82 cooperate to form a second circle. The cylindrical space 86 within that first circle defines the space of the first gray water pass of the heat exchanger, and the cylindrical space 88 within the second circle defines the space of the second gray water pass. As explained below, each of these passes can be seen as a sump, or in some instances where both are linked directly at the bottom as in FIG. 5*g* both taken together can be considered a sump.

The region bounded by side wall portions 76, 78 and internal webs 80, 82 is split, as noted above. It could be split into unequal portions, or asymmetric or nested portions. However, it is convenient that the two portions be of equal cross-sectional area. It is also convenient that the two sub-regions be of the same shape and be symmetrical relative to each other when mirrored in one or more of the x-axis and the y-axis. In the example, third web 84 runs laterally between first web 80 and second web 82, and runs along the line of centers between the first circle and the second circle. This then leaves two internal passageways or conduits identified as a first passageway 90 and a second passageway 92. These passageways can be referred to as feed lines or as returns, or as down pipes, as may be convenient. Although their side portions are formed on the arcs of the circles, they approximate trapezoids in general shape. In the illustrations, first passageway 90 is bounded by half of first web 80, half of second web 82, one side of third web 84 and the inside of tangent side wall portion 76; second passageway 92 is bounded by the other halves of first web 80 and second web 82, the other side of third web 84, and the inside of tangent side wall portion 78.

The tubes or pipes need not be circular. They could be rectangular or square, or polygonal, or of such shape as convenient. As illustrated in FIG. 4*a* they are circular. Similarly, first and second webs 80, 82 need not be circular arcs. They could be straight walls (i.e., planar) and they could extend perpendicular to the tangent walls, or at an oblique angle. It is convenient that they be formed on a circular arc to form a circular cylinder wall. Shell 50 could be rectangular or square as seen in the alternate approach of FIG. 4*c*. The cylindrical tubes forming the first and second gray water passes could be formed as regular bodies of revolution—e.g., circles, ellipses, ovals, and so on, or they could be formed as polygons of however many sides, as in the rectangles of FIG. 4*c*. The first and second down pipes could be round or polygonal, i.e., regular geometric shapes. In FIG. 4*a* they are substantially trapezoidal, except that they are of irregular geometric form given that two of the sides are curved, rather than planar. Whether rounded as in FIG. 4*a*, or polygonal as in FIG. 4*c*, the connecting sides of the first and second tangential webs fall within the lateral projection of the one cylindrical gray water pipe on the other, and so the down pipes fall within that projection. The point is that in either case the result is a relatively compact unit, which may be desirable for installation in a limited space in a dwelling or business.

The front tangent wall portion 76 has an accommodation, or seat, in the form of a first notch 98 cut out of it such that the gray water inlet port fitting 94 can seat in the notch 98 in a lapping and engaging condition. A sealant may be used around the periphery of the notch to make the engagement water-tight. At the far end, there is an opening 99 cut in first web 80 to remove the circular arc portion from tangent wall 76 to the junction with third web 84. This permits incoming gray water, which is warmed after use, to enter at inlet port fitting 94, to descend in down pipe 90, and then to enter circular cylinder 104 from the bottom. In use the gray water then rises inside circular cylinder 104.

At the top of cylinder 104 there is a second notch or second aperture 100 cut in first web 80. Aperture 100 extends from tangent wall 78 to third web 84, such that the top end of circular cylinder 104 is in fluid communication with second down feed pipe 92, which carries the gray water back downward. At the bottom, third web 84 and first web 80 prevent the gray water from flowing back into first gray water pass 52 defined by cylinder 104. Instead, there is another aperture, 101, cut in second web 82 between tangent wall 78 and third web 84 such that the bottom end of down feed pipe 92 is in fluid communication with the bottom end of the second pass defined by second circular cylinder 106. Accordingly, warm gray water can flow out of first cylinder 104, through second down feed pipe 92 and back up second grey water pass 54 of the heat exchanger defined by cylinder 106. In this way, the direction of flow of the gray water in each of the passes is upward.

At the upper end of cylinder 106 there is yet another aperture or accommodation or seat in the form of a notch 102 into which the gray water out-flow port fitting 96 is located. Although the outflow port is shown in FIG. 5*a* centered on the long axis in the y-direction, facing radially outward, it could, in principle, be located anywhere along the arc from the junction with tangent wall 76 to the junction with tangent wall 78. This is represented by the alternate morphology shown in FIG. 5*b* in which the main axes of the inlet and outlet ports are on the same side of the unit and parallel, as opposed to pointing in in other directions, e.g., perpendicular to each other as in FIG. 5*a*.

Each end of heat exchanger shell 50 has an end cap, namely top end cap 56 or bottom end cap 58, as in FIG. 7. Each end cap 56 or 58 has a main web or plate 108 and an upstanding peripheral flange 110 that is sized to receive the peripheral wall of unit 40. Shell member may have, and as shown does have, an outwardly extending peripheral flange 112 which may be in the same plane as plate 108, and which may effectively be an extension of plate 108. End cap 56 or 58 also has internal upstanding walls 114, 116, which conform to the peripheries of the inside of downpipes 90, 92. Internal upstanding walls 114, 116 may also be thought of as, and termed, plugs for the ends of downpipes 90, 92. Each has a pair of end outlets, or inlets, as may be, 118 and 120, that are threaded to permit engagement by an end cap or locking ring 126. The inside diameter allows the passage for installation of the first and second tube bundles. When the end plugs of upstanding walls 114, 116 and peripheral wall are axially engaged with shell 50, flange 110 captures inlet and outlet port fittings 94, 96 in their respective accommodations in the outside wall of shell 50.

Further pipe fittings are mounted to the threaded end fittings of the inlets or outlets 118, 120. At the bottom end of unit 40 those fittings may include a union 124 and a locking ring 126 that house a valve 122. Those pipe fittings themselves are connected in fluid communication with tees 128, 129 that are mutually connected to create a common exhaust manifold 48 that flushes into the main drain, 46. The opposite end of manifold 48 is capped at 148. Cap 148 is removable to permit draining and cleanout of the manifold.

Shell 50 defines a housing for the two fresh water heat exchanger passes 66, 68. In the embodiment illustrated, the fresh water heat exchanger passes defined by first and second tube bundle heat exchangers 66, 68 each have an upper manifold 132, a lower manifold 134, and an array of longitudinally running pipes or tubes 130 extending between the two manifolds. Although longitudinal tube bundles are shown, those bundles could, alternatively, have the form of helical coils, whether of one coil or several coils nested together. In general, it may include any of the embodiments shown and described in U.S. Pat. No. 10,775,112, which may be considered part of this disclosure. In the illustrations, the first tube bundle heat exchanger 66 is the one that receives the fresh water flow first, and the second tube bundle heat exchanger 68 is mounted downstream, in series with the first tube bundle heat exchanger 66. That is, first tube bundle heat exchanger 66 is mounted in second grey water pass 54 and second tube bundle heat exchanger 68 is mounted in first grey water pass 52, such that the fresh water path and the grey water paths are in a counter-flow arrangement. The components of the first and second fresh water passes defined by tube bundles 66 and 68 can be made of copper, stainless steel, or mild steel.

FIG. 3*a* shows a cross-section of first and second grey water passes 52, 54 of apparatus 40, and may be understood as generically comparable to any of the passes shown in the various embodiments herein, with corresponding pipe connections as may be. Apparatus 40 has an external layer of thermal insulation, or a thermal insulation jacket 64 as identified in FIG. 4*a*. Jacket 64 extends from the top of the outer wall to the bottom of the outer wall close to valve 122, as between top end cap 56 and bottom end cap 58.

Apparatus 40 has a heat exchanger fresh water pass or core or tube bundle assembly 66 that is the same as tube bundle assembly 68. They have a set of longitudinal tubes 130 running between an inlet header or manifold 132 captured in place by top end cap 56; and a return or collector, or bottom end header or outlet manifold 134 at the far end, distant from top end cap 56. Inlet manifold 132 is connected to a first, or inlet, pipe 136. Outlet manifold 134 connects to a second, or return, pipe, or leg, 138. Return leg 138 may be centrally mounted to header 134, and may pass centrally through header 132 without being in fluid communication therewith. Inlet header 132 may have the form of a hollow cylindrical disc, or plenum that has multiple outlets connected to, and in fluid communication with, feeds tubes 130. Outlet header 134 may be similar. The end cap of return header 134 may have a domed shape, as above, that is rounded or bulbous. As above, the members of the set or array of tubes 130 may be concentric with return leg 138, although this need not be so. It is not necessary that return leg 138 be straight, although it is straight as illustrated in FIGS. 3*a* and 3*b*. It could be curved. It could be helical. Similarly, tubes 130 need not be straight. They could be angled or curved or helical. Whether a pipe is an "inlet", or an "outlet" is at least to some degree arbitrary. The arrangements of inlets and outlets may typically be intended to cause the flow of heating and cooling fluids to be in opposite directions. Assembly 40 may include two heat exchanger passes, as shown, or three, or four, or some other larger number as may be. In the arrangement described thus far, the warmer water of the gray water flow is intended to enter at the bottom of each of gray water passes 52, 54, and that the relatively colder fresh water under pressure in tubes 136 will descend in first and second passes 52, 54, with return pipes 138 conducting the fresh water back to the top of assembly 40 after passing in counter flow relative to the gray water in the respective passes.

Tubes 130, manifolds 132, 134, inlet pipe 136 and return pipe 138 may combine to form a single tube bundle assembly 140. Assembly 140 may then be installed or removed as a single pre-assembled unit by axial sliding motion into cylinder 104 or 106, as may be. To that end, manifold 132 has a peripheral flange 146 suited to seat on the end of the outer housing shell 50. To that end the outer housing shell pipe wall may have corresponding thickened end fittings 118, 120 and locking rings 126 that capture the tube bundles 140 in place. When this occurs, the inside periphery of the upper manifold engages, and compresses, a seal 144 that bottoms on plate 108. As seen, outlet pipe 138 passes through both the inner and outer walls of inlet manifold 132. Seals are made on both walls through which pipe 138 passes. Outlet pipe 138 may be encased in insulation, or in a jacket that reduces the flow path cross-sectional area in the remainder of the chamber inside the outer jacket.

Heat exchanger assemblies, 66, 68 may then be installed or removed as single pre-assembled units 140. Tube bundle assembly 140 is internally coated, or externally coated, or both internally and externally coated, in a non-electrically conductive coating applied to all surfaces, such that a continuous electrical barrier is formed. The coating is of small thickness relative to the parts of assembly 40 generally. The non-electrically conductive coating may be paint, or enamel, or epoxy. It may be a hygienic polyurethane or silicone and may be applied, internally or externally, e.g., as by dipping in a bath, followed by subsequent curing. The non-electrically conductive coating is, and functions as, a non-conductive coating between the fresh water and waste water paths of the heat exchangers.

Assembly 40 also has at least one sensor or one terminal (which may be an array of sensors or terminal ends distributed to various locations along the fresh water flow path) indicated as 184 of an electrical conductivity sensor assembly or circuit, 180. First sensor 184 may be located in one of end manifolds 132, 134 of the tube bundle, and, in particular, it may be located in upper manifold 132. A second terminal, or an array of second termini, 186 is similarly located in the waste water pass. Terminal 186 may be located below the standing water level of the sump, i.e., below the resting water level RWL of the particular sump. It may be located near the bottom of the sump, and the wiring of the sensor may be run back to the top of the sump, and pass through the shell wall where it may be twinned with the lead of the other sensor terminal and joined in a common plug or connector. Electrical conductivity terminals 186 may be mounted in each sump of each pass to permit detection of a leak in whichever pass it should occur. Terminals 184 may be mounted in each fresh-water pass, and may be formed into a combined terminal connector for each pass, as at 194. In another embodiment, a single terminal 184 in a continuous fresh water path may also be used, since a rise in conductivity in any of the sumps will be sensed in the fresh water line.

Electrical conductivity sensor assembly or circuit 180 may be a capacitance-based or a resistance-based conductivity sensor assembly. The leak detection circuit senses at least one of (a) resistance; and (b) voltage potential between said fresh water flow path and said gray water flow path. It may include a power supply 188. Power supply 188 may be a DC supply of low or very low voltage. It has a power storage capability, e.g., such as a battery, that continues to operate if electrical power has failed in the building more generally, as in the case of a power outage. That is, it operates to provide power independently of the availability of external power. Thus, even if fresh water pressure is lost due to an electrical pump failure or other upstream flow interruption or shut off, for example, circuit 180 will remain in operation. Circuit 180 may also include a signal output annunciator or alarm or display, indicated at 192, which may include a normal signal (e.g., a green light) to indicate that the system is in operation but not in a fault condition; and an alarm signal whether noise-making or visual, or both, or that sends an electronic message to a message receiving device, such as a phone or e-mail address, or any combination of them (e.g., a red light, or fault, or alarm condition). Display 192 may be part of a controlling microprocessor, or controller 190. In normal operation, circuit 180 detects an open circuit between terminal 184 and terminal 186. However, in the event that a leak should develop between the fresh water system and the waste water system, circuit 180 detects a conductivity path, and provides an alarm signal corresponding to that red light, fault, or alarm condition.

Electrical conductivity sensor circuit 180 may also control the operation of valves by which to adjust operation of assembly 40 from a first condition or position or configuration (e.g., normal operation) to a second condition or position or configuration (e.g., a fail-safe condition). That is, assembly 40 may be provided with a first solenoid controlled valve (S1) indicated as 196 and a second solenoid controlled valve (S2), indicated as 198. It is arbitrary which valve is designated as the first or second valve.

The detection of electrical conductivity between terminals 184 and 186 is interpreted as being an indication of a leak between the fresh water and waste water sides of the heat exchanger. In normal operation, this should be benign, since the fresh water system is pressurized typically at 30-50 psi., and the waste water system is essentially at ambient, i.e., less than 5 psi., such that any leak will flow away from the fresh system to the waste system, and not into the domestic supply. However, in the event that source pressure is shut off in the fresh water system, and a leak is detected, the first of the solenoid controlled valves, 196 opens the sump drainage valves and dumps the waste water sumps (however many there may be) directly to drain 30. At the same time, the second of the solenoid controlled valves 198 opens the fresh water bypass 178, such that fresh water supply is directed around the waste water heat recovery apparatus and directly to water heater 166 (or to such other fresh water supply line as may be, whether hot or cold). Where source pressure is applied through the bypass valve 198, a check valve is positioned in the fresh water output line 164 is placed to prevent back flow into the waste water heat recovery heat exchanger passes. Apparatus 40 may also be provided with a fresh water shut-off valve 176 which may be co-operably mounted with fresh water bypass valve 198, and that may prevent additional fresh water from flowing into the waste water heat recovery apparatus. In some embodiments, the respective sump valves 122 may be the solenoid controlled valve, or valves, 196.

The leak detection features of apparatus 40 may be applied to the other embodiments shown or described herein, whether having coils or tube bundles. The leak detection circuit operates to govern whether flow is directed (in one mode) through the fresh water flow path or (in another mode) through the fresh water bypass e.g., directly to the water heater, as when a leak is detected. Similarly, the leak detection circuit governs whether gray water is directed in a first mode to the gray water flow path, or, in a second mode, is directed to the drain.

Following the gray water, which is presumed to be the hot side flow (that is, incoming gray water is assumed to be warmer than incoming fresh water), main gray water drain line 38 arrives at a tee to which overflow bypass 42 is connected. The output line of drain line 38 is connected to inlet port fitting 60 that feeds the infeed passageway of first down flow pipe 90 that leads into first pass 52. As shown, gray water is carried downward in passageway 90 to the bottom of first pass 52. At the bottom of first pass 52 there is a normally closed outlet identified as bottom union 126 whose output is controlled by one of valves 122. As described above, the main portion of the body of first pass 52 has the form of a round cylindrical pipe portion 104 of shell 50 of the apparatus 40. Shell 50 may be made of any suitable drain piping material, and may, if desired, be externally insulated. In one example shell 50 may be PVC or ABS or metal pipe. Shell 50 may have a length that is an order of magnitude, or more, greater than the diameter of cylinder 104 of first pass 52 or cylinder 106 of second pass 54. In one example first pass 52 and second pass 54 may be of ABS pipe material and have nominal 4" diameters (i.e., the inside wall defines a 4" (10 cm) diameter passageway). Other sizes may be used. The cylinders may have a nominal 6" (15 cm) internal diameter. Shell 50 (and all of the other gray water piping discussed herein) may likewise be any kind of pipe suitable for drain installations, and may typically be a plastic or reinforced plastic pipe, be it ABS, PVC or some other. To the extent that heat transfer through the outer wall is not desired, shell 50 may tend not to be made of copper, or may be externally insulated, or both. The bottom end of shell 50 is closed off by the valves 122 blocking outlets 118 and 120 of bottom end cap 58. In the embodiment shown, the end closure fittings of the closed end as closed by valves 122. Valves 122 may be opened when it is desired to flush out the clean out at the bottom of the respective sumps. In normal operation valves 122 will be closed. At the upper end of first pass 52 there is an off-take or outlet, namely the accommodation of second notch 98 which allows gray water to exit first pass 52 and enter second down pipe 92, defining the gray-water outlet or discharge of first pass 52. The uppermost end of shell 50 is closed by another end closure or end closure fitting such as a top end cap 56. And its locking rings 126 that capture and seal flanges 146 against the end faces of outlet ports 118, 120 of top cap 56, and that compress seals 144.

Second down feed pipe 92 extends from notch 100 to the bottom of shell 50 to the inlet of second pass 54. At the bottom, or lower portion, where there is again a flushing or clean-out drain controlled by a valve 122. Second stage 54 similarly has the form of a cylindrical pipe 106, typically of the same diameter and material as that of first pass 52, with an outlet or off-take, or discharge as at outlet fitting 96 of outlet port 62. The outlet or discharge of second pass 54, being the outlet of gray water from heat recovery apparatus 40 more generally, is connected to drain into main drain 46. That is, the gray water and septic water systems are segregated upstream, but drain into a common flow at the outlet juncture, at 156. The gray water path may be considered to be the hot side, or hot path, of the heat exchanger, from which heat is extracted.

The other side of the heat exchanger, typically termed the cold side or cold path, is designated generally as 170. It is the side of the heat exchanger to which heat is transferred or rejected. The cold side may typically provide a flow for inlet water under pressure, typically 30-50 psi. of a municipal fresh water supply. The fresh water may typically enter from buried pipe, the cold water temperature may often be in the range of 40-50 F. The cold water pipe, being a pipe under pressure, may typically be a copper pipe, although stainless steel or any other suitable pressure line pipe may also be used.

The cold water supply, after having passed through the water meter, may have a tee at which one side 21 is directed to the cold water outlets in the building, and another side 23 through which fresh water flow is directed to the hot water distribution system. As shown, the hot water heater distribution feeder line 158 enters the first pass 66 at an inlet 172. The cold water supply may then have a heat exchange element, namely first tube bundle 66, that has been axially inserted within second cylindrical space 106, and is captured in place by end locking ring 126. The locking ring 126 is centrally open to permit the inlet and outlet cold water pipes 172, 178 to protrude outwardly. At the lower end of the tube bundle, the run in the other direction, such as may be called the "return" leg 138, that also passes through both the inlet manifold 132 and locking ring 126, to its end or termination, or outlet connection, be it a coupling, union, adapter, or other pipe fitting. Return leg 138 may run within the array of pipes 130. It need not be centered in array 130, but may be offset from center. It is nonetheless convenient that it be centered. To avoid confusion, the term "counter-direction leg" may be used in place of "return leg". The use and installation of such fittings are thought to be well understood by persons of skill in the art. It is foreseen that heat transfer between the fresh water and the gray water occurs predominantly in array of downpipes.

The cold water pipe leaving first tube bundle 66 (i.e., leaving second pass 54) then passes through a transfer tube or pipe to second tube bundle 68 installed in first pass or stage 52. The fresh water heat exchange element in first pass 52 may be different from that in second pass 54, in the general case, but may typically be the same as heat exchange assembly 140. Again, heat exchange assembly 140 may have tube bundle pipe array 130 and a return 138. Again, it is thought that heat transfer occurs predominantly between the array and the gray water, which are in counterflow relationship. To the extent that it may be desired to reduce heat transfer from the straight leg portion of return 138, it may be insulated. For the ranges of temperatures, and the temperature differentials, under consideration, the undesired heat transfer in the straight leg portion may be relatively small, and it may in some embodiments be used without insulation.

The outlet fresh water pipe from first gray water pass 52 may then be carried through (i.e., connected to) piping 164 to the inlet of a domestic hot water heater 166, such that apparatus 40 functions as a pre-heater in the hot water side of the fresh water system. The hot water pipes leaving water heater 166 feeds the various hot-water taps or connections in the building, such as the sinks, showers, clothes washing machine, dishwasher, and so on. The gray water system may then provide the drain, or drains, for these elements, and the heat subsequently extracted from the gray water is used to pre-heat incoming fresh water.

As may be noted, the connections of the transfer lines of the fresh water to be pre-heater are such that the overall direction of travel of the fresh water in the heat exchanger arrays is opposite to the direction of travel of the gray water in the corresponding cylindrical pipe, 104 or 106. That is, where the array carries the fresh water downward, the gray water is moving upward. A seal, such as an O-ring may be mounted to the top end inside locking ring 126 to aid inclamping flange 146 of inlet manifold 132 against port 118 of top cap 56. As noted, another seal 144 is mounted where the inside face of the manifold seats on the lip of plate 108 inside end ports 118, 120.

The entrance and exit of the fresh water lines to each of the heat exchange passes, i.e., tube bundle assemblies 140, is above the level of the outlet port 62 of apparatus 40. That is, even when the gray water inflow is not flowing, and the unit is passive, the water level may be expected to be at the level of the lower lip of outlet port fitting 96. As such, the dominant portion, or substantially all, or all, of the fresh water pipe array may tend to remain immersed even when the gray water is not flowing. In that sense, cylindrical spaces 104 and 106 may be considered to be, or to define, a sump or series of sumps, or collectors one leading to the next, in those portions lower than the outlet overflow, e.g., that of outlet 96 or 100 as may be. That is, where outlet 96 is higher than outlet 62, the resting fluid level, or resting water level, "RWL", in sump 122 will be governed by the height of the outlet, and the resting height of fluid in the sump will be governed by the height of outlet notch 102. Where outlet 96 is lower than outlet notch 102, the resting fluid level of both sumps, or sump portions, will be governed by the height of the height of outlet notch 102 in one and fitting 96 in the other.

There alternate arrangements of inlet and outlet ports, whether on opposite sides of the unit, the same side, or angled relative to each other with one on a side face and one on an end face. As shown in FIG. 2*a*, and so on, the grey water inlet is on a side face feeding directly into the first down-flow passageway, 90. The inlet and outlet port fittings have inside and outside flanges with a rabbet between the flanges that admits the width of the shell wall, such that the inlet and outlet ports fit in a snug relationship with the walls of shell 50.

In FIG. 3*c*, the apparatus is substantially the same as that of FIG. 3*a*. It has inlet and outlet gray water ports 206, 208 that are substantially the same as port fittings 94, 96, except that the inlet and outlet gray water port fittings 206 and 208 have spouts 210, 212 that are tilted upwardly. As so formed, the bottom lip at the outermost end of the spout is elevated relative to the bottom lip of the inside of the spout, such that the resting height of water will be higher, as suggest by the height dimension $h_{206}$ in FIG. 3*c*. By having an upwardly angled spout, the bodies of fittings 206, 208 may sit in their respective rabbets or notches 100, 102 in the side walls of shell 50, below the level of plate 108; whereas the resting water level may be higher, much closer to, or corresponding to, the level of plate 108, more or less. Expressed differently, the difference in water level height between the resting water level at the lip to the underside of plate 108 is reduced to less than the nominal diameter of the spout. In the example shown, that difference is less than ¼ the spout diameter. As shown is quite close to zero. The effect of this feature is to reduce the portion of the length of the tube bundle legs that is exposed above the water, or, conversely, to increase the proportion of those tube bundle legs that are submerged in the gray water, so that an increased area of the sides of the tube bundle pipes participates in heat transfer from liquid to liquid.

In the alternate assembly of FIG. 5*g*, the bottom end of the unitary shell member 50 has openings 202, 204 formed in the first and second internal webs 80 and 82 to permit gray water to flow directly from the first gray water pass 52 into the second gray water pass 54, such that a U-shaped well or sump is formed. This permits an alternate manner of setting up the apparatus and eliminates flow through the respective first and second down pipes 90, 92, which may then be capped. The embodiment of FIG. 5*g* is otherwise substantially the same as apparatus 40, except that the gray water inlet of first pass 52 is at, or near, the top thereof, and the transfer to second pass 54 occurs at a low level, as at, or just above, bottom cap 56 and just above clean-out 142 (see FIG. 3*b*). In this case, two valves 122 could be used for cleanout or by-pass, as described above in the context of FIG. 3*b*, or a single three-way valve 220 could be used, as in FIG. 3*b*. The connections of the fresh water system are again such as to cause the inlet fresh water in the arrays to flow in the opposite direction of the gray water as the fresh water advances through pipe arrays. That is, in contrast to FIG. 2*b*, in FIG. 5*h*, the discharge from return 138 first fresh water tube bundle 66 in second grey water pass 32 is connected to "return" 138 of second tube bundle 68 in first gray water pass 52, and the discharge of second tube bundle 68 is then through the nominal "input" port 136, which is then the output. This reversal of pipe connections means that the counter-flow arrangement of the fresh water relative to the gray water is retained in first pass 52, in which the gray water is now flowing downward rather than upward. In this embodiment, the resting gray water fluid level in both sumps is governed by the level of outlet port 62. In this context, there may be considered to be two sump portions (corresponding to gray water passes 52 and 54) that define a single sump.

In the normal course of operation, fresh water is only admitted to water heater 166 (and hence to apparatus 40) when a hot water tap is opened in the building. Customarily, that water is then drained, possibly with some time delay (after the dishes are washed, the clothes washer fills and drains, or the bathtub or sink is emptied). The drained gray water, which may be warm (up to 60 C=140 F for dishwashers and clothes washers; perhaps up to 45 C=110 F for sinks, bath-tubs, and showers) as compared to ambient indoor temperature (20-25 C=68-80 F) in the building, is then the drainage inflow that displaces the gray water previously collected in the sump of the first and second stages of apparatus 40.

Although full counter-flow embodiments is shown in FIGS. 3*a* and 3*b*, in which the gray water flows through all four internal passages of shell 50, alternate embodiments are possible. For example, as noted above FIG. 5*g* shows an embodiment in which first and second gray water passes 52, 54 are linked at the bottom to form a single well that has a U-shape, as discussed above. In FIG. 5*g*, the direction of flow in gray water first stage 52 is downward, and therefore counter to the upward direction of flow in second stage 54.

In the alternate embodiment of FIG. 3*b*, rather than employing two clean out valves 122, there is a single three-way valve, 220 that is mounted to the bottom end of first grey water pass 52, and that has a connection to bottom tee 128 attached to the bottom of second grey water pass 54. In one position, as illustrated, valve 220 is closed, such that gray water cannot flow from either first pass 52 or second pass 54 to main drain 46. It is also movable through 180 degrees to a second position in which grey water can flow directly from first pass 52 into the bottom end of second pass 54. In this position if clean out end cap 148 is open, the bottom of first and second passes 52 and 54 can both be cleaned out. Instead, if rotated counter-clockwise 135 degrees to a third position, both first and second passes 52 and 54 are able to flow to drain 46.

As shown, the pressurized fresh water lines do not have penetrations of the cylindrical shell side wall. Rather, the junction is in the end closure fitting or end plug, or cap, or closure, or closure member, however it may be called. The use of a standard fitting or cap, or plug, permits a known mating between the plug and the seat of the cylinder, which is a proven mating technology, of wide availability, and of simplicity and reliability. It is used also at the solid end or closure or plug that caps off the bottom end of the cylinder as well. In the various embodiments, the bottom closure of each pass is governed by one or another of the clean out fittings, be it a drain fitting, or trap, or valve, 122. In operation, with the clean out fitting closed, the bottom closure of valve 122 may be considered as functionally equivalent to a blind end fitting or cap, or plug, i.e., without any fresh water line penetrations, as if it were a solid blank or cap through which flow does not occur. Flow only occurs through that end when the system is being flushed, e.g., to clean out debris. Where apparatus 40 is monitored or controlled by an electronic controller or timed or programmed device, the flushing or clean-out step may occur periodically, such as once a day, once a week, or once a month, and may occur at a time when it is not likely to affect operation, e.g., in the middle of the night. Given that cylinders 104, 106 accommodate the heat exchange arrays they are larger in diameter than the inlet, outlet, flushing, overflow, and other gray water flow pipes described. The heat exchanger pipe arrays can be pre-formed, mated with the pipe stems, and the pipe stem fittings mated to, or potted in, the end closure fitting or cap or plug. Installation (and removal or replacement, as may be) occurs by axial translation of the heat exchanger array in the respective cylinders. The cylinders may be of nominal 5" dia, with a 5" inside diameter in which a heat exchanger array of 4" or 4-½" outside diameter may be located. In another embodiment the pipe may be 6" nominal diameter, with a 6" inside diameter wall housing a 5" or 5-½" diameter array may be installed. In each case, the first pass (or second pass, or third pass, etc.), and therefore the respective reservoir, or receptacle, sump or sump portion, has a shell wall defined by the pipe. Each cylinder, or pass or receptacle or sump is substantially longer in the axial direction than wide in terms of diameter. In use these members may be upstanding, being upright or predominantly upright. In a tall thin reservoir or sump, the depth and volume of the sump tend to be large as compared to the surface area of the liquid in the sump. The hydraulic diameter of the resting liquid surface may be less than one tenth of the depth of the sump below the outlet.

The wall penetrations of the inlet and outlet port fittings 94, 96 can have their flanges and rabbets potted in an epoxy or other moulded compound to form a durable seal. As the fitting penetration is located above the level of the drain, and therefore above the resting fluid level in the sump, even if the fitting should be imperfect, or if it should loosen over time, it may tend not to result in leakage, and it may tend even then to be relatively easy to obtain access to the fitting for repair or replacement.

Further, the cylinders may tend to be substantially longer than their diameter, such that the axial flow length is much longer than the diameter of the cylindrical pipe, e.g., 10 times the length, or more. In one installation, the overall height of the cylinder is between 4 ft and 7 ft, with a diameter of about 4 inches. That is, the height may be intended to fit within the clearance provided by an 8 ft ceiling, and may be approximately the same as, or comparable to, the height of a water heater, which may typically be about 5 ft, the size depending on whether the tank is nominally 30, 40, 50, or 60 gallons. It may be that the overall height of the heat exchanger apparatus may be in the range of 2/3 to 3/2 of the height of the adjacent water heater 166. It may be more convenient, and more compact in terms of floor space occupied, for the cylinder bundle to be arranged vertically, or substantially or predominantly vertically, or upright. The pre-heater heat exchange or heat recovery apparatus, 40, may be mounted beside hot water heater 166, in a furnace or other utility room, for example, and may occupy a physical footprint of comparable size, or less.

In summary, assembly 40 is for use in a gray water heat recovery apparatus and is installed in a unitary shell 50, such as a plastic cylindrical tube or pipe to define a first heat exchanger pass for use in the various embodiments described above. The external shell 50 has cylinders 104, 106. Each pass has a tube bundle assembly, namely assembly 130. External shell 50 can also, alternatively, be formed of a mild steel, stainless steel, or copper pipe with a layer of thermal insulation 64, or a plastic shell with an additional layer of thermal insulation 64. The cylindrical plastic shell has a first end and a second end. In operation, the first end is located higher than the second end—the gray water flow path elements form a gravity flow conduit. The second end, i.e., the bottom end is blocked to form a sump within the cylindrical plastic shell 50. Cylindrical plastic shell 50 has a first port and a second port. The bottom lip of the outlet port fitting 96 defines a resting water level when gray water is contained in the sump defined by that cylinder below that lip. The first inlet port defines an inlet for gray water to the cylindrical plastic shell. The second port defines the outlet for gray water from the cylindrical plastic shell. Accordingly, the passageways in cylindrical plastic shell 50 defines a flow path for gray water between the inlet and the outlet thereof. The first end of the cylinders of shell 50 provide an entry, or entryway, into which to admit the lower end, and substantially the entire body of assembly 66 or 68, up to flange 146, which acts as a stop to locate assembly 130 longitudinally in its axially installed position relative to cylinder 104 or 106, as may be. The tube bundle 66 or 68 is sized to fit within the entry at the first end of the respective plastic pipe cylinder. The outside peripheral cylindrical wall of upper manifold 132 is sized to nest with little or no slack or tolerance within the open end of cylinder 104, 106, although it could be any suitable size for mating with, or within, those cylinder ends. During installation the tube bundle is axially slidable within shell 50 to reach the position dictated by the abutment of flange 146 with the open-end fitting 118 or 120 of top end plate 56, as may be.

What has been described above has been intended illustrative and non-limiting and it will be understood by persons skilled in the art that changes and modifications may be made without departing from the scope of the claims appended hereto, particularly in terms of mixing-and-matching the features of the various embodiments as may be suitable. Various embodiments of the invention have been described in detail. Since changes in and or additions to the above-described best mode may be made without departing from the nature, spirit or scope of the invention, the invention is not to be limited to those details but only by a purposive reading of the appended claims as required by law.

We claim:

1. A gray water heat recovery apparatus comprising:

a housing assembly that includes a one-piece cylindrical gray water shell, said shell having a first gray water pass and a second gray water pass;

the first and second gray water passes having respective top and bottom ends;

the first and second gray water passes being in fluid connection in series;

said first and second gray water passes combining to define a gravity driven gray water discharge path;

a first tube bundle being removably installed in said second gray water pass by axial insertion at said top end of said second gray water pass;

a second tube bundle being removably installed in said first gray water pass by axial insertion at said top end of said first gray water pass;

said first and second tube bundles being pressurized fresh water tube bundles;

each of said first and second tube bundles having an inlet manifold; a return manifold; an array of heat exchanger tubes extending between and in communication with said inlet manifold and said return manifold; and a return;

said first and second tube bundles, when installed, being connected in series and in counterflow to said first and second gray water passes of said shell;

said top end of said shell having at least a first divider between said first gray water pass and said second gray water pass;

said shell having an upstanding peripheral wall;

said upstanding peripheral wall having first and second gray water port fittings mounted therein, one of said fittings being a gray water inlet in fluid communication to feed said first and second gray water passes in series, and the other of said fittings being a gray water outlet at which gray water exits from said shell after having passed through said first and second gray water passes in series;

said housing assembly including a top end cover that closes said top end of said first and second passes; and said top end cover, when installed, capturing said first and second gray water port fittings in said upstanding peripheral wall of said gray water shell.

2. The gray water heat recovery apparatus of claim 1 wherein said shell is connected to cause gray water to rise in both said first and second gray water passes when said gray water heat recovery apparatus is in operation.

3. The gray water heat recovery apparatus of claim 1 wherein said tube bundles each have a respective said array of heat exchanger tubes in which to carry fresh water from a respective said inlet manifold to a respective said return manifold, and a return to pipe connected to carry fresh water from said return manifold to said top end of said shell; and said first and second tube bundles are connected to cause fresh water to descend in said respective arrays of heat exchanger tubes during operation of said gray water heat recovery apparatus.

4. The gray water heat recovery apparatus of claim 2 wherein said tube bundles each have a respective said array of a plurality of heat exchanger tubes in which to carry fresh water from a respective said inlet manifold to a respective said return manifold, and a return pipe connected to carry fresh water from said return manifold to said top end of said shell; and said first and second tube bundles are connected to cause fresh water to descend in said respective arrays of heat exchanger tubes during operation of said gray water heat recovery apparatus.

5. The gray water heat recovery apparatus of claim 1 wherein said shell includes at least a first gray water return connected to convey gray water between a respective said bottom end of one of said first and second gray water passes and the top end of the other of said gray water passes.

6. The gray water heat recovery apparatus of claim 1 wherein said cylindrical shell includes a first gray water down pipe, said first gray water down pipe having a first end at said top end of said cylindrical shell and a second end at said bottom end of said cylindrical shell; said first end receives water from said gray water inlet, and said second end of said first down pipe feeds said first gray water pass.

7. The gray water heat recovery apparatus of claim 6 wherein said first gray water down pipe is located between said first and second gray water passes.

8. The gray water heat recovery apparatus of claim 7 wherein said first gray water down pipe has a cross-section of irregular shape.

9. The gray water heat recovery apparatus of claim 1 wherein said cylindrical shell includes a second gray water down pipe, said second gray water down pipe having a first end at said top end of said cylindrical shell and a second end at said bottom end of said cylindrical shell; said first end of said second down pipe receives water from said first gray water pass, and said second end of said second down pipe feeds said second gray water pass.

10. The gray water heat recovery apparatus of claim 8 wherein said first and second gray water down pipes are located side-by-side between said first and second gray water passes.

11. The gray water heat recovery apparatus of claim 7 wherein said first and second gray water passes have respective regular-shaped peripheries, said shell has at least first and second joining webs extending between and connecting said first and second gray water passes, and said first gray water down pipe located between said first and second joining webs.

12. The gray water heat recovery apparatus of claim 7 wherein said first and second gray water passes have a cross-section of a cylindrical body of revolution; said shell has first and second tangent members that extend tangentially between said first and second cylindrical bodies of revolution, and said first gray water down pipe is located between said first and second tangential members.

13. The gray water heat recovery apparatus of claim 12 wherein there is a second gray water down pipe, and it is located between said first and second gray water passes and between said first and second tangential members beside said first gray water down pipe.

14. The gray water heat recovery apparatus of claim 1 wherein at least one of said first and second gray water passes has a bottom valve movable between open and closed positions to permit flushing of the respective one of said at least one of said first and second gray water passes.

15. The gray water heat recovery apparatus of claim 1 wherein said apparatus includes a three way valve operable between a first position closing said first and second gray water passes from each other; a second position opening said first and second gray water passes to exhaust to a drain; and a third position opening said first and second gray water passes to permit cleanout.

16. The gray water heat recovery apparatus of claim 1 wherein said first and second gray water passes are in fluid communication at the respective said bottom ends thereof to form a unified sump.

17. The gray water heat recovery apparatus of claim 1 wherein said apparatus includes a leak detection circuit.

18. The gray water heat recovery apparatus of claim 1 wherein said gray water inlet fittings and outlet fittings slide axially into slots formed in said peripheral wall of said shell.

19. The gray water heat recovery apparatus of claim 1 wherein said shell is wrapped in thermal insulation.

20. The gray water heat recovery apparatus of claim 1 wherein said shell is formed of extruded plastic.

* * * * *